US010204468B2

(12) United States Patent
Akagi et al.

(10) Patent No.: US 10,204,468 B2
(45) Date of Patent: Feb. 12, 2019

(54) PAPER SHEET INSERTION APPARATUS

(71) Applicant: GLORY LTD., Himeji-shi, Hyogo (JP)

(72) Inventors: Masayuki Akagi, Himeji (JP); Hisashi Ishitobi, Himeji (JP); Yuki Maeda, Himeji (JP); Kenichiro Akita, Himeji (JP); Saori Kobayashi, Himeji (JP)

(73) Assignee: GLORY LTD., Himeji-shi, Hyogo (JP)

( * ) Notice: Subject to any disclaimer, the term of this patent is extended or adjusted under 35 U.S.C. 154(b) by 0 days.

(21) Appl. No.: 15/633,872

(22) Filed: Jun. 27, 2017

(65) Prior Publication Data

US 2017/0294068 A1 Oct. 12, 2017

Related U.S. Application Data

(63) Continuation of application No. 15/123,722, filed as application No. PCT/JP2015/050448 on Jan. 9, 2015, now Pat. No. 9,721,417.

(30) Foreign Application Priority Data

Mar. 6, 2014 (JP) ..... 2014-044242
Jan. 9, 2015 (WO) ..... PCT/JP2015/050448

(51) Int. Cl.
*B65H 7/14* (2006.01)
*G07D 11/00* (2006.01)
(Continued)

(52) U.S. Cl.
CPC ..... *G07D 11/0036* (2013.01); *B65H 7/02* (2013.01); *B65H 7/06* (2013.01); *B65H 7/14* (2013.01);
(Continued)

(58) Field of Classification Search
CPC ..... B65H 2511/521; B65H 2701/1912; B65H 7/14; B65H 7/02; G07D 11/0036;
(Continued)

(56) References Cited

U.S. PATENT DOCUMENTS 6,400,276 B1 * 6/2002 Clark ..... G07F 19/20 340/541
8,953,045 B2 * 2/2015 Priesterjahn ..... G07F 19/20 235/379
(Continued)

FOREIGN PATENT DOCUMENTS

CN 1904961 A 1/2007
JP 2004-157665 A 6/2004
(Continued)

OTHER PUBLICATIONS

Japanese Office Action with English Translation (Japanese Application No. 2014-044242) (11 pages—dated Nov. 2, 2017).
(Continued)

*Primary Examiner* — Luis A Gonzalez
(74) *Attorney, Agent, or Firm* — Renner, Kenner, Greive, Bobak, Taylor & Weber

(57) ABSTRACT

A paper sheet insertion apparatus (for example, depositing and dispensing unit 20) includes an imaging unit (for example, camera 60) that takes an image of an interior of the paper sheet handling machine 10 to obtain image data and a control unit (for example, depositing and dispensing unit control unit 72) that is provided inside the machine body of the paper sheet handling machine 10 and outputs information on foreign material other than the paper sheet and information on a constituent member of the paper sheet insertion apparatus, based on the image data obtained by the imaging unit.

12 Claims, 12 Drawing Sheets

(51) Int. Cl.
*B65H 7/06* (2006.01)
*B65H 7/02* (2006.01)

(52) U.S. Cl.
CPC ..... *G07D 11/0018* (2013.01); *G07D 11/0051* (2013.01); *G07D 11/0081* (2013.01); *B65H 2511/521* (2013.01); *B65H 2701/1912* (2013.01)

(58) Field of Classification Search
CPC .... G07D 11/0018; G07D 7/181; G07D 7/189; G07F 19/20; G07F 19/202; G07F 19/203; G07F 19/205
See application file for complete search history.

(56) References Cited

U.S. PATENT DOCUMENTS

| | | | |
|---|---|---|---|
| 9,394,137 | B2 | 7/2016 | Ando et al. |
| 2008/0035446 | A1 | 2/2008 | Yoshida et al. |

FOREIGN PATENT DOCUMENTS

| | | | |
|---|---|---|---|
| JP | 2004-232459 | | 8/2004 |
| JP | 2004-232459 | A | 8/2004 |
| JP | 2005-92799 | A | 4/2005 |
| JP | 2007-34936 | A | 2/2007 |
| JP | 4650149 | B2 | 12/2010 |
| JP | 2011-113348 | A | 6/2011 |
| JP | 2012-113514 | A | 6/2012 |
| JP | 2015-135588 | A | 7/2015 |

OTHER PUBLICATIONS

Chinese Office Action with English Translation (Application No. 201580011923.X) (19 pages—dated Apr. 28, 2018).

English Translation of the Written Opinion of the International Searching Authority (International Appl. No. PCT/JP2015/050448) (3 pages—dated Apr. 14, 2015).

* cited by examiner

PAPER SHEET INSERTION APPARATUS

CROSS-REFERENCE TO RELATED APPLICATION

This is a Continuation of U.S. patent application Ser. No. 15/123,722 filed on Sep. 6, 2016, which was the National Stage of International Application No. PCT/JP2015/050448 filed on Jan. 9, 2015, which claimed the benefit of priority from the Japanese Patent Application No. 2014-044242 filed on Mar. 6, 2014, the entire contents of which are incorporated herein by reference.

TECHNICAL FIELD

The present invention relates to a paper sheet insertion apparatus for inserting paper sheets into a machine body of a paper sheet handling machine, a paper sheet handling machine that includes the paper sheet insertion apparatus, and a paper sheet insertion method.

BACKGROUND ART

To date, a technique for detecting, when a foreign material other than banknotes is included in a banknote inlet of a banknote depositing and dispensing device, the foreign material included therein, has been known. For example, Japanese Patent No. 4650149 discloses the following technique. That is, an image of a foreign material receiver unit provided below a banknote inlet is taken by a camera, the obtained image is compared with an image representing a state where no foreign material is present. It is detected, when there is a difference therebetween, that a foreign material is included, the taken image of the foreign material is displayed, and a user is required to confirm whether or not it is to be returned. Further, in the banknote depositing and dispensing device disclosed in Japanese Patent No. 4650149, a camera can be moved to a position at which an image of the inside of a banknote storage unit for storing banknotes put in the banknote inlet, is taken.

SUMMARY OF THE INVENTION

A paper sheet insertion apparatus of the present invention is a paper sheet insertion apparatus for inserting a paper sheet into a machine body of a paper sheet handling machine, the paper sheet insertion apparatus including: an imaging unit that takes an image of an interior of the paper sheet handling machine to obtain image data; and a control unit that is provided inside the machine body of the paper sheet handling machine and outputs information on foreign material other than the paper sheet and information on a constituent member of the paper sheet insertion apparatus, based on the image data obtained by the imaging unit.

In the paper sheet insertion apparatus of the present invention, the constituent member may include a shutter closing a paper sheet inlet through which the paper sheet is put into the paper sheet insertion apparatus, and the control unit may output information on a fake shutter based on the image data obtained by the imaging unit before and after opening the shutter.

In the paper sheet insertion apparatus of the present invention, the constituent member may include a guide member attached to the paper sheet insertion apparatus and having a size corresponding to the size of the paper sheet, and the control unit may output information on the guide member based on the image data of the guide member obtained by the imaging unit.

In this case, the control unit may determine a kind of the guide member.

In the paper sheet insertion apparatus of the present invention, the imaging unit may obtain image data including a side edge portion of the paper sheet inside the paper sheet insertion apparatus.

In the paper sheet insertion apparatus of the present invention, the foreign material other than the paper sheet may be a bundling member for bundling paper sheets.

A paper sheet insertion apparatus of the present invention is a paper sheet insertion apparatus for inserting a paper sheet into a machine body of a paper sheet handling machine, the paper sheet insertion apparatus including: an imaging unit that is provided inside the machine body of the paper sheet handling machine and takes an image of a side edge portion of the paper sheet inside the paper sheet insertion apparatus to obtain image data; and a control unit that outputs information on foreign material other than the paper sheet based on the image data obtained by the imaging unit.

The paper sheet insertion apparatus of the present invention may further includes a placement unit in which a plurality of paper sheets are placed in a standing state on a placement member; and the imaging unit may take an image of a side edge portion facing the placement member, of the plurality of paper sheets placed in the placement unit, or a side edge portion, on a side opposite to the side edge portion facing the placement member, of the plurality of paper sheets placed in the placement unit, to obtain image data.

In the paper sheet insertion apparatus of the present invention, the foreign material other than the plurality of paper sheets may be a bundling member for bundling paper sheets.

A paper sheet insertion apparatus of the present invention is a paper sheet insertion apparatus for inserting a paper sheet into a machine body of a paper sheet handling machine, the paper sheet insertion apparatus including: an imaging unit that is provided inside the machine body of the paper sheet handling machine and takes an image of the paper sheet inside the paper sheet handling machine to obtain image data; and a control unit that outputs information on a bundling member for bundling paper sheets, based on the image data obtained by the imaging unit.

In the paper sheet insertion apparatus of the present invention, the imaging unit may take an image of a side edge portion of the paper sheet.

In this case, the paper sheet insertion apparatus of the present invention may further include a placement unit in which a plurality of paper sheets are placed in a standing state on a placement member; and the imaging unit may take an image of a side edge portion facing the placement member, of the plurality of paper sheets placed in the placement unit, or a side edge portion, on a side opposite to the side edge portion facing the placement member, of the plurality of paper sheets placed in the placement unit, to obtain image data.

DETAILED DESCRIPTION OF THE INVENTION

Figure 1:
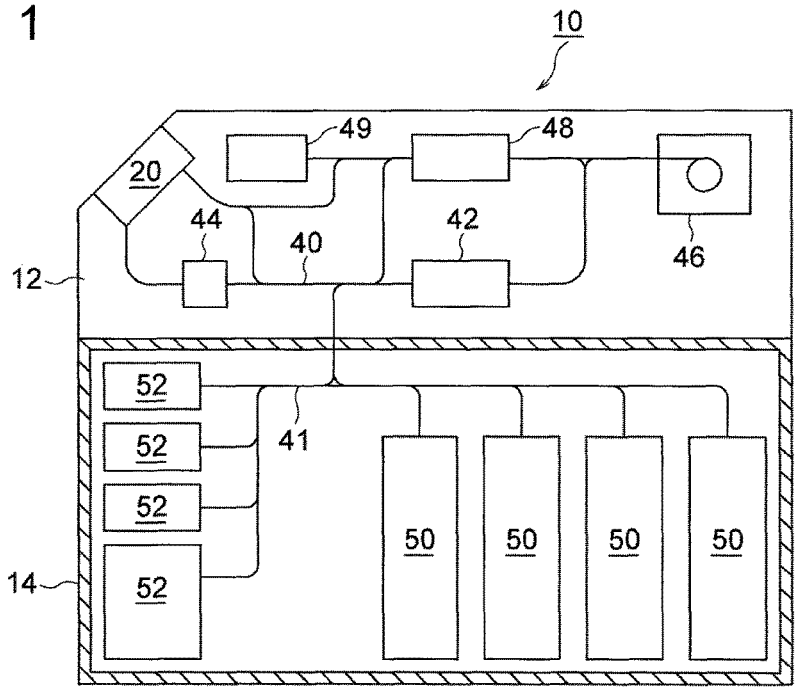
FIG. 1 schematically illustrates a structure of a banknote handling machine according to an embodiment of the present invention.
Figure 8:
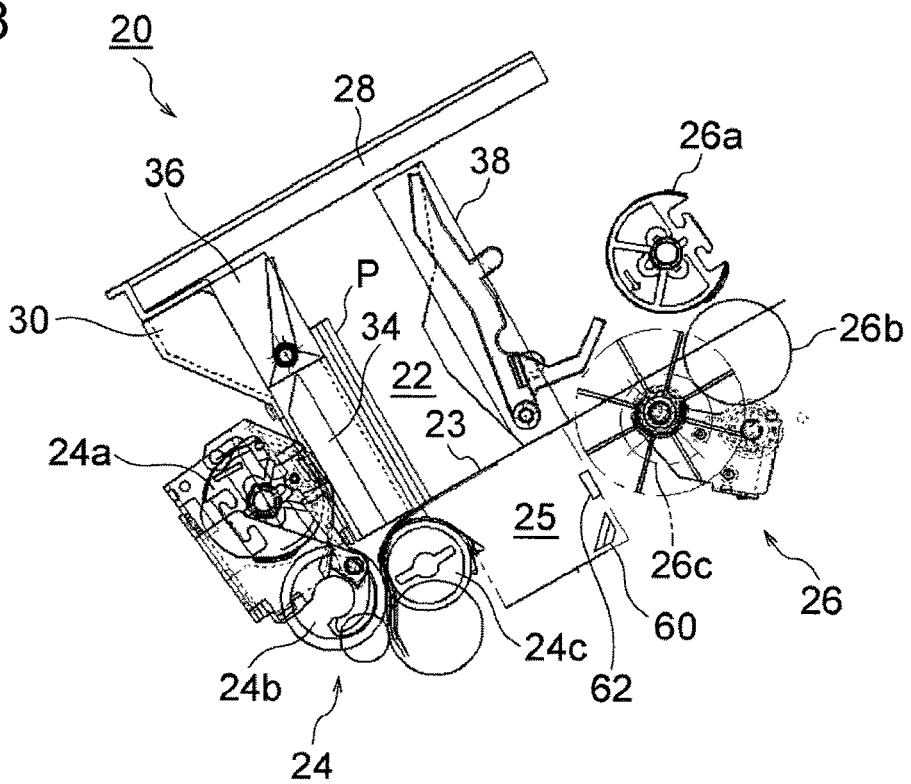
FIG. 8 illustrates the structure of the depositing and dispensing unit in the banknote handling machine shown in FIG. 1, and illustrates an operation, in the banknote dispensing, performed following the operation shown in FIG. 7.
Figure 9:
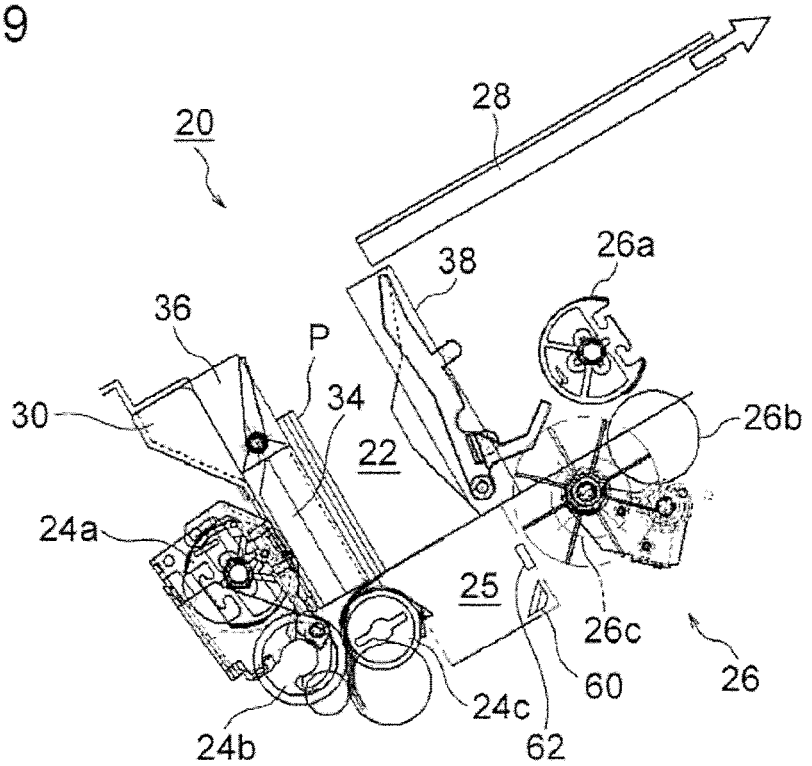
FIG. 9 illustrates the structure of the depositing and dispensing unit in the banknote handling machine shown in FIG. 1, and illustrates an operation, in the banknote dispensing, performed following the operation shown in FIG. 8.
Figure 10:
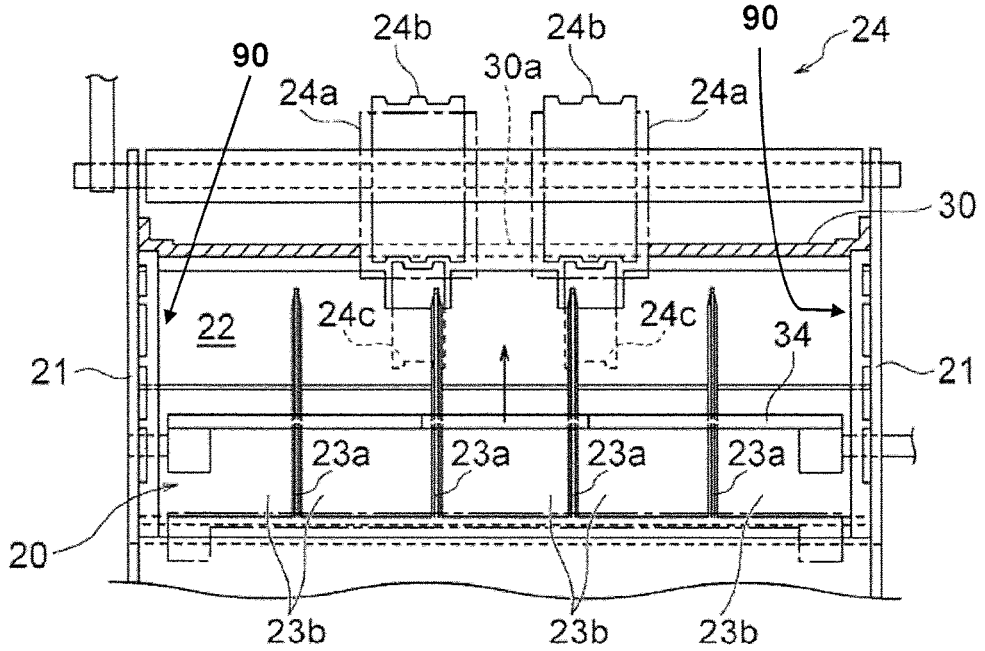
FIG. 10 is a top view illustrating a structure of a placement unit as seen from above the depositing and dispensing unit in the banknote handling machine shown in FIG. 1.
Figure 11:
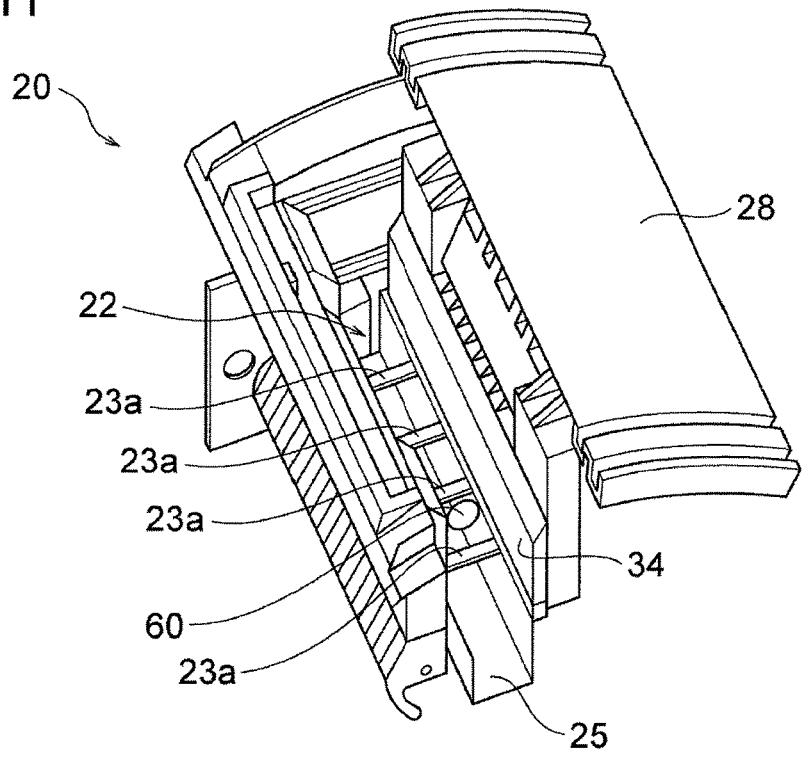
FIG. 11 is a perspective view illustrating the structure of the depositing and dispensing unit in the banknote handling machine shown in FIG. 1.
Figure 12:
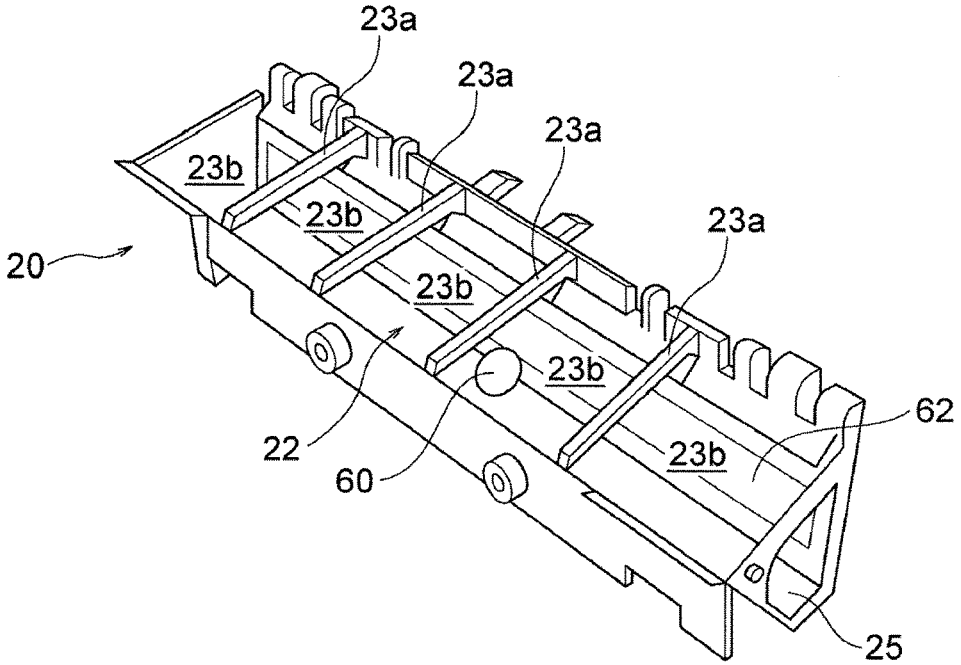
FIG. 12 is a perspective view illustrating placement members in the placement unit and a place, below the placement members, at which a camera is installed, in the depositing and dispensing unit shown in FIG. 11.
Figure 13:
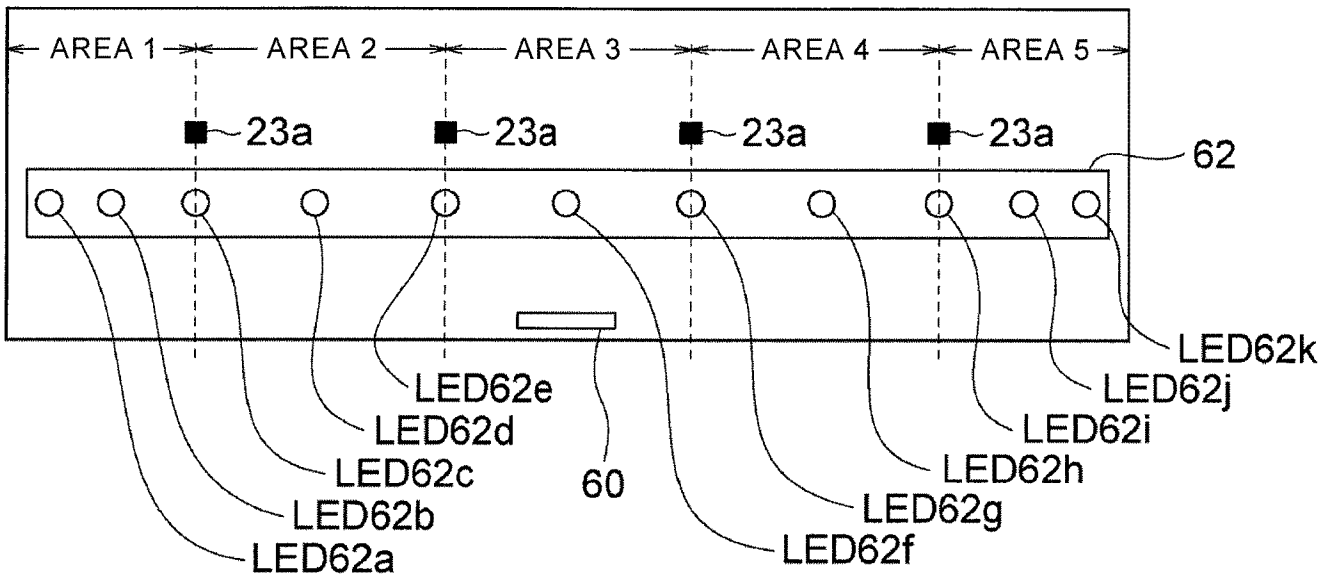
FIG. 13 illustrates a positional relationship between a light source and the camera in the depositing and dispensing unit shown in FIG. 11.
Figure 14:
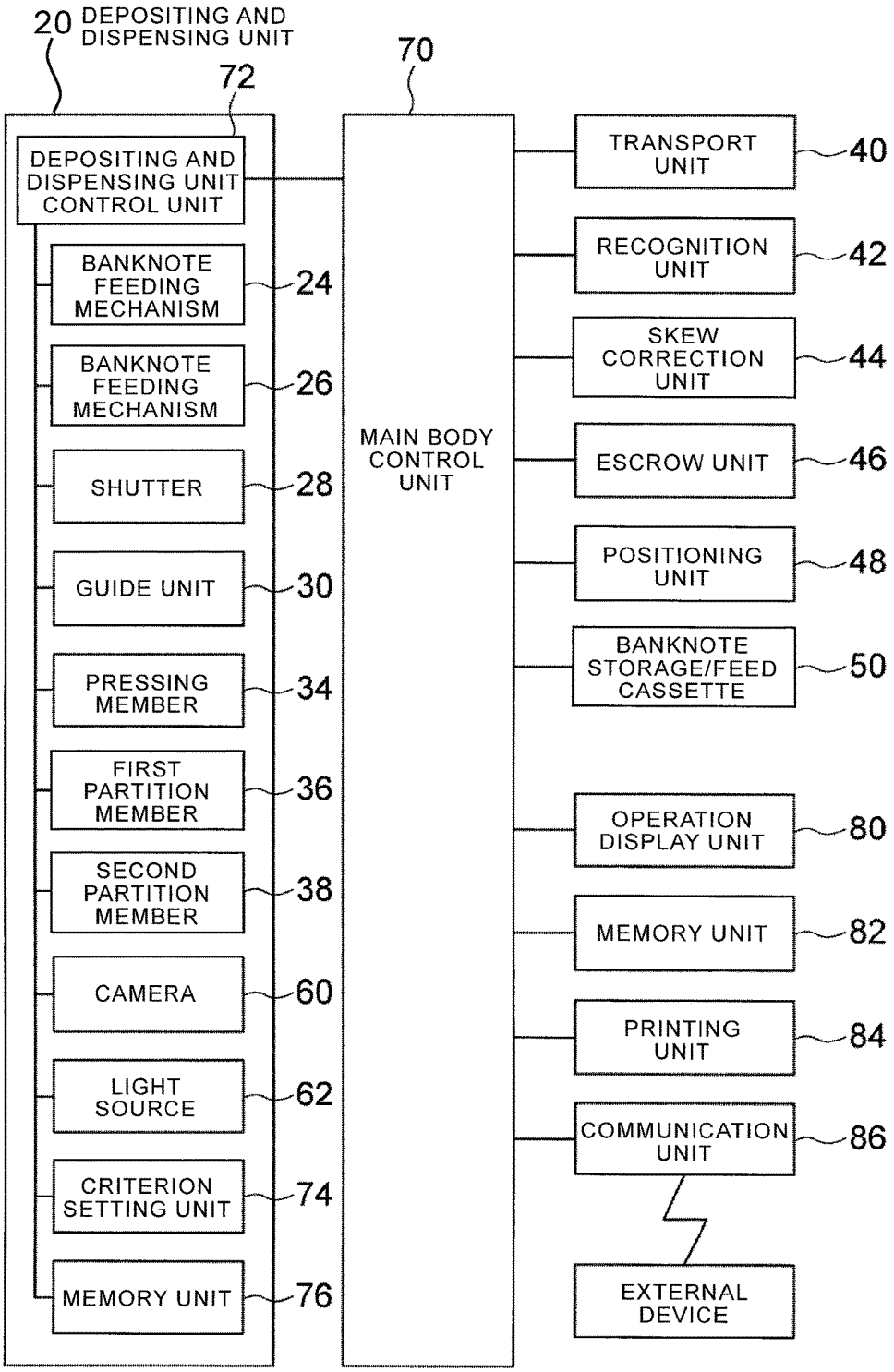
FIG. 14 is a functional block diagram illustrating the banknote handling machine shown in FIG. 1.
Figure 15:
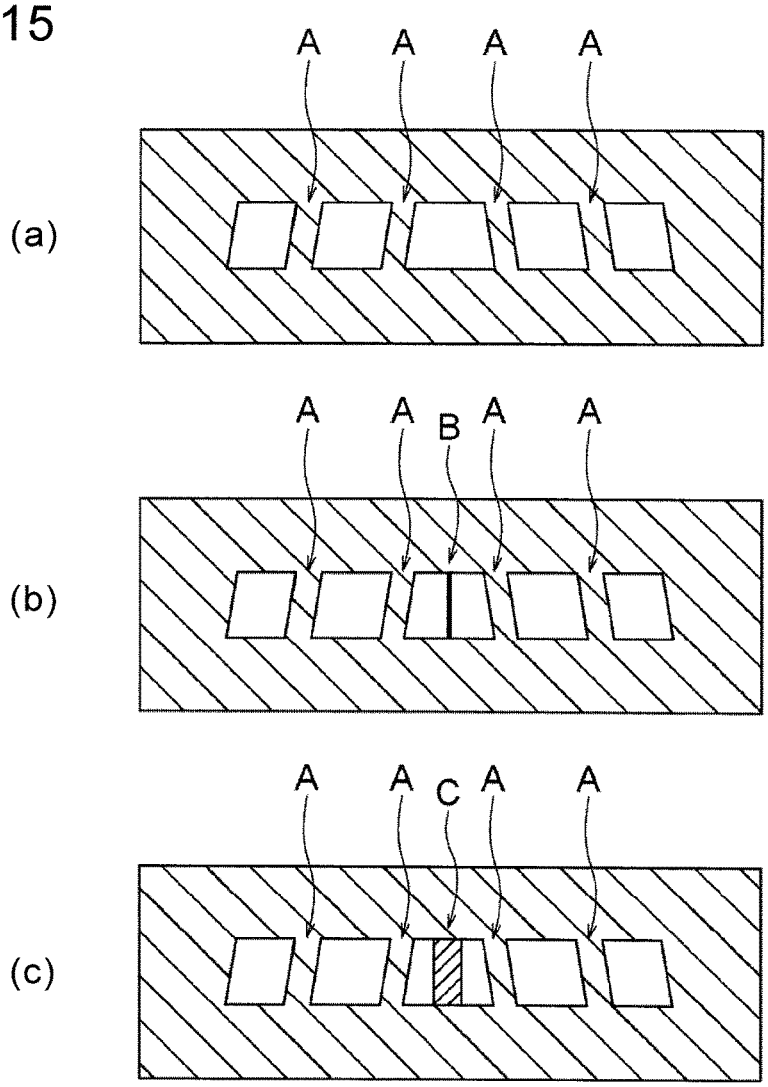
FIG. 15 illustrates, in (a) to (c) thereof, data of images taken by the camera provided in the depositing and dispensing unit of the banknote handling machine shown in FIG. 1.
Figure 16:
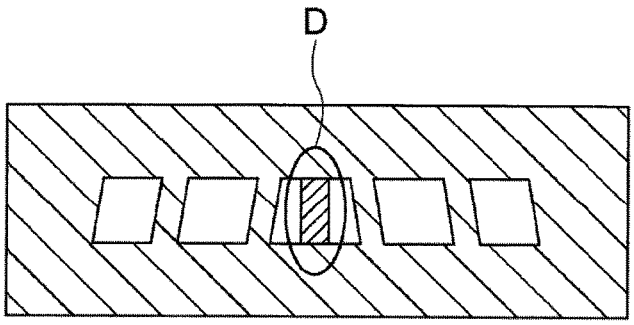
FIG. 16 illustrates image data, outputted by a control unit of the banknote handling machine shown in FIG. 1, in which a portion where a bundling member is present is marked.

Hereinafter, an embodiment of the present invention will be described with reference to the drawings. FIG. 1 to FIG. 16 each illustrate a structure of a banknote handling machine according to the present embodiment. Among them, FIG. 1 schematically illustrates a structure of the banknote handling machine according to the present embodiment. FIG. 2 to FIG. 5 illustrate a structure of a depositing and dispensing unit in the banknote handling machine shown in FIG. 1, and illustrate operations performed in banknote depositing. FIG. 6 to FIG. 9 illustrate the structure of the depositing and dispensing unit in the banknote handling machine shown in FIG. 1, and illustrate operations performed in banknote dispensing. FIG. 10 is a top view illustrating a structure of a placement unit as seen from above the depositing and dispensing unit in the banknote handling machine shown in FIG. 1. FIG. 11 is a perspective view illustrating the structure of the depositing and dispensing unit in the banknote handling machine shown in FIG. 1. FIG. 12 is a perspective view illustrating placement members in the placement unit and a place, below the placement members, at which a camera is installed, in the depositing and dispensing unit shown in FIG. 11. FIG. 13 illustrates a positional relationship between a light source and the camera in the depositing and dispensing unit shown in FIG. 11. FIG. 14 is a functional block diagram illustrating the banknote handling machine shown in FIG. 1. FIG. 15 illustrates, in (a) to (c) thereof, data of images taken by the camera provided in the depositing and dispensing unit of the banknote handling machine shown in FIG. 1. FIG. 16 illustrates image data, outputted by a control unit of the banknote handling machine shown in FIG. 1, in which a portion where a bundling member is present is marked.

Firstly, the entire structure of a banknote handling machine 10 according to the present embodiment will be described with reference to FIG. 1. As shown in FIG. 1, the banknote handling machine 10 according to the present embodiment includes an upper housing 12 and a lower housing 14. The upper housing 12 includes a depositing and dispensing unit 20 for inserting banknotes into the upper housing 12 from the outside thereof and dispensing banknotes from the inside of the upper housing 12 to the outside thereof. The structure of the depositing and dispensing unit 20 will be described below in detail. Inside the upper housing 12, a transport unit 40 for transporting banknotes one by one is connected to the depositing and dispensing unit 20. A recognition unit 42 is provided in the transport unit 40, and the recognition unit 42 performs, for example, recognition of denominations, authentication, and recognition of fitness for the banknotes transported by the transport unit 40. At this time, the recognition unit 42 can obtain serial numbers of the banknotes. The transport unit 40 includes a skew correction unit 44, and, when banknotes fed from the depositing and dispensing unit 20 into the transport unit 40 are transported in a skewed state, the skewed state is corrected by the skew correction unit 44. A tape-reeling type escrow unit 46 is connected to the transport unit 40. The escrow unit 46 has a drum that is rotatable in both the forward direction and the reverse direction, and a pair of tapes is reeled by the drum. The banknotes transported from the transport unit 40 to the escrow unit 46 are sequentially rolled one by one by the drum in a state where the banknotes are nipped between the paired tapes, and the banknotes are stored. When the drum is rotated in the reverse direction, the banknotes having been rolled are fed one by one and transported to the transport unit 40. The transport unit 40 includes a positioning unit 48, and positioning is performed by the positioning unit 48 such that the banknote transported by the transport unit 40 is positioned at a predetermined position (for example, the central position) in the width direction of the transport path. A counterfeit note storage unit 49 is connected to the transport unit 40 and a banknote recognized as a counterfeit note by the recognition unit 42 is transported to the counterfeit note storage unit 49 by the transport unit 40, and stored in the counterfeit note storage unit 49.

The lower housing 14 serves as a so-called safe, and only a person such as a manager who has a specific authority is allowed to open a door of the lower housing 14 and access the inside thereof. Inside the lower housing 14, a transport unit 41 that transports banknotes one by one is provided. The transport unit 41 is connected to the transport unit 40 provided in the upper housing 12. Thus, handing-over of banknotes can be performed between the upper housing 12 and the lower housing 14. A plurality of banknote storage/feed cassettes 50 are provided in parallel with each other in the lower housing 14, and each of the banknote storage/feed cassettes 50 is connected to the transport unit 41. The banknotes transmitted by the transport unit 41 are stored in the banknote storage/feed cassettes 50 by, for example, denomination. Each of the banknote storage/feed cassettes 50 includes a banknote feeding mechanism (not shown) that feeds the stored banknotes one by one to the transport unit 41. Inside the lower housing 14, a plurality of banknote storage cassettes 52 are provided in parallel with each other, and each of the banknote storage cassettes 52 is connected to the transport unit 41. Each of the banknote storage cassettes 52 stores banknotes transported by the transport unit 41. The banknote storage cassettes 52 store: overflow banknotes which cannot be stored in the banknote storage/feed cassette 50 for a corresponding denomination since the banknote storage/feed cassette 50 for the denomination is full; a banknote recognized as a counterfeit note by the recognition unit 42; a banknote of which the denomination is not assigned to any of the banknote storage/feed cassettes 50; an unfit note which cannot be used for dispensing; banknotes (banknotes left inadvertently) which are not taken by an operator (customer) and are left after the banknotes have been transported, in dispensing, to the depositing and dispensing unit 20; and the like. The banknote storage cassettes 52 in which the above-described various kinds of banknotes are to be stored, can be optionally set.

Next, an operation of the banknote handling machine 10 as described above in various handling such as depositing and dispensing will be described.

When banknote depositing is performed by the banknote handling machine 10, an operator inputs a deposit instruction by using an operation display unit 80 (described below) such as a touch panel, whereby a shutter 28 (described below) of the depositing and dispensing unit 20 opens. Thereafter, when banknotes are put into the depositing and dispensing unit 20, the shutter 28 of the depositing and dispensing unit 20 is closed. Thereafter, the banknotes are fed one by one to the transport unit 40 by a banknote feeding mechanism 24 (described below) provided in the depositing and dispensing unit 20. The skew state of the banknotes fed to the transport unit 40 is corrected by the skew correction unit 44, and the recognition unit 42 then performs, for example, recognition of denominations, authentication, and recognition of fitness for the banknotes. The banknote recognized as a counterfeit note by the recognition unit 42 is transported to the counterfeit note storage unit 49 by the transport unit 40, and stored in the counterfeit note storage unit 49. Meanwhile, the banknotes recognized as normal banknotes by the recognition unit 42 are transported to the escrow unit 46 by the transport unit 40 and are escrowed in the escrow unit 46. A rejected note recognized by the recognition unit 42 as being not a normal banknote may be returned to the depositing and dispensing unit 20 by the transport unit 40. After all the banknotes put into the depositing and dispensing unit 20 are fed into the upper housing 12, and transported to the escrow unit 46, the counterfeit note storage unit 49, and/or the like, the operator inputs an instruction for deposit acceptance by using the operation display unit 80 (described below), whereby the banknotes escrowed in the escrow unit 46 are stored in the banknote storage/feed cassettes 50 by denomination by means of the transport units 40 and 41.

When banknote dispensing is performed by the banknote handling machine 10, the banknotes stored in the banknote storage/feed cassettes 50 are fed one by one to the transport unit 41 by the banknote feeding mechanism provided in each banknote storage/feed cassette 50, and are handed over from the transport unit 41 to the transport unit 40, and the recognition unit 42 then performs, for example, recognition of denominations, authentication, and recognition of fitness for the banknotes. The banknote recognized as normal banknotes by the recognition unit 42 are each positioned, by the positioning unit 48, at a predetermined position (for example, the central position) in the width direction of the transport path, and are then transported to the depositing and dispensing unit 20 and stacked in the depositing and dispensing unit 20. Meanwhile, a banknote recognized by the recognition unit 42 as being not a normal banknote is transported to the escrow unit 46 and escrowed in the escrow unit 46. When a predetermined monetary amount of banknotes are transported from the banknote storage/feed cassettes 50 to the depositing and dispensing unit 20, the shutter 28 of the depositing and dispensing unit 20 opens, whereby an operator can take out the banknotes from the depositing and dispensing unit 20 to the outside of the upper housing 12. The banknotes escrowed in the escrow unit 46 are fed from the escrow unit 46, and the fed banknotes are transported to the banknote storage/feed cassette 50 or the banknote storage cassette 52 by the transport unit 40 and the transport unit 41. In a case where the banknotes are not taken out from the depositing and dispensing unit 20 when a predetermined time has elapsed after opening of the shutter 28 of the depositing and dispensing unit 20, the banknotes are fed one by one from the depositing and dispensing unit 20 to the transport unit 40 by a banknote feeding mechanism 26 (described below), and pass through the recognition unit 42, whereby the denominations of the banknotes are recognized. Thereafter, the banknotes are escrowed in the escrow unit 46, and the escrowed banknotes are then fed from the escrow unit 46, and the fed banknotes are transported to the banknote storage/feed cassette 50 or the banknote storage cassette 52 by the transport unit 40 and the transport unit 41. Alternatively, in a case where the banknotes are not taken out from the depositing and dispensing unit 20 when a predetermined time has elapsed after opening of the shutter 28 of the depositing and dispensing unit 20, the banknotes may be fed one by one from the depositing and dispensing unit 20 to the transport unit 40 by the banknote feeding mechanism 26 (described below), pass through the positioning unit 48 and then pass through the recognition unit 42, whereby the denominations of the banknotes are recognized, and thereafter the banknotes may be transported to the banknote storage/feed cassette 50 or the banknote storage cassette 52 by the transport unit 40 and the transport unit 41.

Next, the structure of the depositing and dispensing unit 20 provided in the banknote handling machine 10 will be described in detail with reference to FIG. 2 to FIG. 13. In FIG. 2 to FIG. 9, banknotes in the depositing and dispensing unit 20 are represented by reference character P. In the present invention, the depositing and dispensing unit 20 as described below is implemented as the banknote insertion apparatus for inserting banknotes into the machine body of the banknote handling machine 10.

Figure 2:
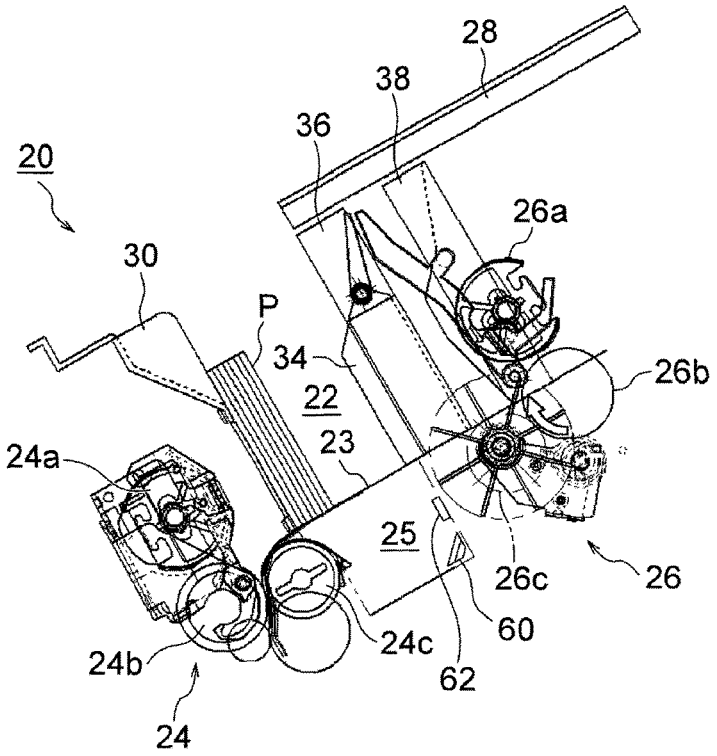
FIG. 2 illustrates a structure of a depositing and dispensing unit in the banknote handling machine shown in FIG. 1, and illustrates an operation performed in banknote depositing.

As shown in FIG. 2 and the like, the depositing and dispensing unit 20 includes a placement unit 22 in which a plurality of banknotes are placed in a standing state. FIG. 10 is a top view illustrating a structure of the placement unit 22 as seen from above the depositing and dispensing unit 20. As shown in FIG. 10, the placement unit 22 is formed between paired left and right side walls 21, and the placement unit 22 has, on a bottom surface 23 thereof, a plurality of bar-like placement members (ribs) 23*a* that extend in parallel with each other. In the placement unit 22, a bundle of banknotes is placed in a standing state on and over the plurality of placement members 23*a*. Spaces 23*b* each having a size sufficient for dropping a foreign material, such as a coin or a clip, other than a banknote, are formed between the placement members 23*a*. Each placement member 23*a* has a mountain-shaped cross-section, and only the top portion of the mountain-shaped cross-section contacts with the lower edge portion of the bundle of banknotes. Since each placement member 23*a* has such a mountain-shaped cross-section, a contact area in which the lower edge portion of the bundle of the banknotes and each placement member 23*a* contact with each other, is reduced. Thus, when the bundle of the banknotes is pressed toward the banknote feeding mechanism 24 described below by a pressing member 34 described below, the placement members 23*a* do not prevent movement of the banknotes. As shown in FIG. 2 and the like, below the placement unit 22, a foreign material receiver unit 25 for receiving a foreign material which drops from the placement unit 22 through the spaces 23*b* is provided.

On one of side portions of the placement unit 22, the banknote feeding mechanism 24 is provided which feeds, into the upper housing 12, the banknotes placed in the standing state in the placement unit 22. The banknote feeding mechanism 24 includes: a kicker roller 24*a* for kicking downward the banknote located at the left-lowermost position in FIG. 2 and the like, among the banknotes placed in the placement unit 22; a feed roller 24*b* for feeding, into the upper housing 12, the banknote kicked downward by the kicker roller 24*a* to transport the banknote to the transport unit 40; and an opposing roller 24*c* that is provided so as to contact with the feed roller 24*b* and that forms a gate unit (nip unit) between the feed roller 24*b* and the opposing roller 24*c*. Even when a plurality of banknotes are kicked downward by the kicker roller 24*a*, the banknotes are separated one by one by the gate unit formed between the feed roller 24*b* and the opposing roller 24*c*.

Also on the other of the side portions of the placement unit 22, the banknote feeding mechanism 26 is provided which feeds, into the upper housing 12, the banknotes placed in the standing state in the placement unit 22. The banknote feeding mechanism 26 is used to feed again the banknotes transported from the transport unit 40 to the placement unit 22, into the upper housing 12, when banknote dispensing is performed. Similarly to the banknote feeding mechanism 24, the banknote feeding mechanism 26 includes: a kicker roller 26*a* for kicking downward the banknote located at the right-uppermost position in FIG. 2 and the like, among the banknotes placed in the placement unit 22; a feed roller 26*b* for feeding, into the upper housing 12, the banknote kicked downward by the kicker roller 26*a* to transport the banknote to the transport unit 40; and an opposing roller 26*c* that is provided so as to contact with the feed roller 26*b* and that forms a gate unit (nip unit) between the feed roller 26*b* and the opposing roller 26*c*. Even when a plurality of banknotes are kicked downward by the kicker roller 26*a*, the banknotes are separated one by one by the gate unit formed between the feed roller 26*b* and the opposing roller 26*c*. In the banknote dispensing, when banknotes are transported from the transport unit 40 to the placement unit 22, the banknotes transported from the transport unit 40 pass through the gate unit formed between the feed roller 26*b* and the opposing roller 26*c*, and are placed in the standing state in the placement unit 22.

Figure 3:
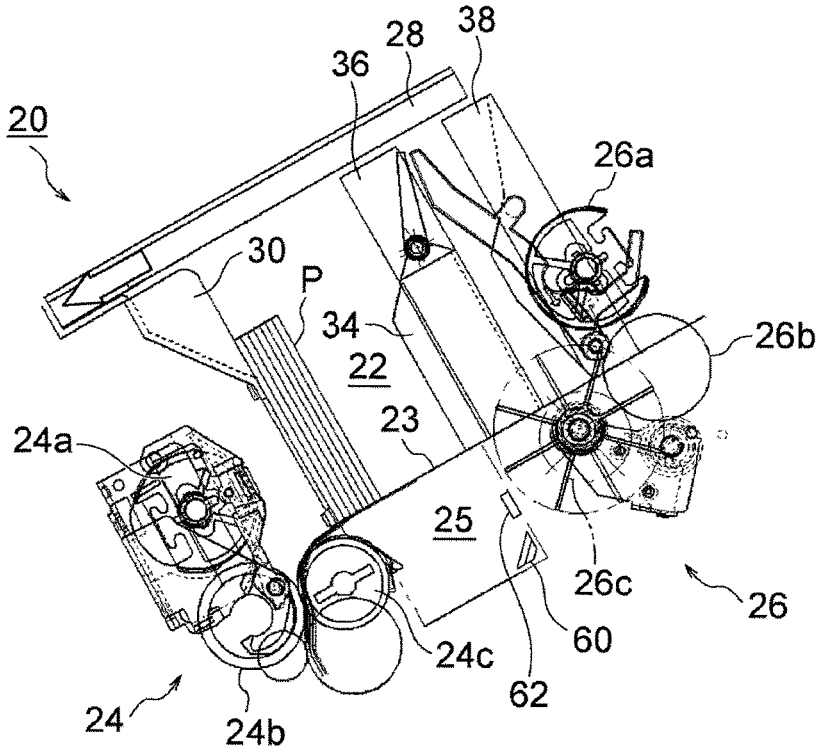
FIG. 3 illustrates the structure of the depositing and dispensing unit in the banknote handling machine shown in FIG. 1, and illustrates an operation, in the banknote depositing, performed following the operation shown in FIG. 2.

The depositing and dispensing unit 20 includes the shutter 28 for opening and closing the placement unit 22. The shutter 28 moves between an opening position at which the placement unit 22 opens to allow an operator to put her/his hand into the placement unit 22 as shown in FIG. 2, and a closing position at which the placement unit 22 is closed to prevent an operator from putting her/his hand into the placement unit 22 as shown in FIG. 3.

Near the kicker roller 24*a* of the banknote feeding mechanism 24, a guide unit 30 that forms a side surface on the banknote feeding mechanism 24 side in the placement unit 22 is provided. The guide unit 30 is movable along the bottom surface 23 of the placement unit 22 so as to be close to the banknote feeding mechanism 24 and distant from the banknote feeding mechanism 24.

The depositing and dispensing unit 20 includes the pressing member 34 that presses, toward the banknote feeding mechanism 24, a bundle of banknotes placed in the placement unit 22. The pressing member 34 is movable along the bottom surface 23 of the placement unit 22 so as to be close to the banknote feeding mechanism 24 and distant from the banknote feeding mechanism 24. When the pressing member 34 moves so as to be close to the banknote feeding mechanism 24 in a state where banknotes are placed in the placement unit 22, a bundle of banknotes placed in the placement unit 22 is pressed toward the banknote feeding mechanism 24 by the pressing member 34, and a banknote located at the left-lowermost position in FIG. 2 and the like, among the banknotes placed in the placement unit 22, is fed into the upper housing 12 by the banknote feeding mechanism 24.

The depositing and dispensing unit 20 includes a first partition member 36 and a second partition member 38 for dividing the placement unit 22 into a plurality of regions. The first partition member 36 and the second partition member 38 are each movable along the bottom surface 23 of the placement unit 22 so as to be close to the banknote feeding mechanism 24 and distant from the banknote feeding mechanism 24. An inlet region into which banknotes are put by an operator in banknote depositing is formed between the guide unit 30 and the pressing member 34. Meanwhile, an outlet region into which banknotes are transported from the transport unit 40 through the gate unit formed between the feed roller 26*b* and the opposing roller 26*c* in banknote dispensing is formed between the first partition member 36 and the second partition member 38. The pressing member 34 described above is disposed between the guide unit 30 and the first partition member 36.

In the banknote handling machine 10 of the present embodiment, a camera 60 for taking an image of the inside of the depositing and dispensing unit 20 at a wide angle is disposed below the placement members 23*a* of the placement unit 22 in the depositing and dispensing unit 20. As shown in FIG. 2 to FIG. 9, FIG. 11, FIG. 12, and the like, the camera 60 is disposed on the bottom surface of the foreign material receiver unit 25, and the camera 60 takes an image of the side edge portion (lower edge portion), on the placement member 23*a* side, of a bundle of banknotes placed on the placement members 23*a* of the placement unit 22 to obtain image data. In the foreign material receiver unit 25, a light source 62 is disposed above the camera 60, and the light source 62 applies light to the placement unit 22. Since the light source 62 is thus provided, although the placement unit 22 is closed by the shutter 28, light is applied to the placement unit 22 by the light source 62, whereby the camera 60 can take an image of the side edge portion, on the placement member 23*a* side, of a bundle of banknotes placed on the placement members 23*a* of the placement unit 22.

As shown in FIG. 13, the light source 62 includes a plurality of LEDs (light source portions) 62*a* to 62*k* aligned along the width direction (left-right direction in FIG. 13) of the banknotes placed in the standing state on the placement members 23*a* of the placement unit 22. More specifically, the placement unit 22 is divided into a plurality of areas by the placement members 23*a* (specifically, the placement unit 22 is divided into five areas that are an area 1 to an area 5 by the four placement members 23*a*), and, in the areas and at boundaries between the adjacent areas, the LEDs 62*a* to 62*k*, respectively, are disposed. The camera 60, which is positioned below the light source 62, is disposed in the area (specifically, area 3) located at the center of the plurality of the areas.

As shown in FIG. 14, the banknote handling machine 10 of the present embodiment includes a main body control unit 70 for controlling components of the banknote handling machine 10. To the main body control unit 70, the depositing and dispensing unit 20, the transport unit 40, the recognition unit 42, the skew correction unit 44, the escrow unit 46, the positioning unit 48, and the banknote storage/feed cassettes 50 are connected. A result of recognition of a banknote by the recognition unit 42 is transmitted to the main body control unit 70. The main body control unit 70 transmits a command signal to each of the depositing and dispensing unit 20, the transport unit 40, the skew correction unit 44, the escrow unit 46, the positioning unit 48, and the banknote storage/feed cassettes 50, thereby controlling these components. As shown in FIG. 14, to the main body control unit 70, the operation display unit 80, a memory unit 82, a printing unit 84, and a communication unit 86 are connected. The operation display unit 80 has, for example, a touch panel provided on the front surface or the top surface of the upper housing 12 of the banknote handling machine 10, and displays information on a banknote handling state, an inventory amount, and/or the like in the banknote handling machine 10. An operator is allowed to input various instructions by means of the operation display unit 80. In the memory unit 82, information on a banknote handling state, an inventory amount, and/or the like in the banknote handling machine 10 is stored. The printing unit 84 includes, for example, a printer for printing, on a receipt or the like, information on a banknote handling state, an inventory amount, and/or the like in the banknote handling machine 10. The communication unit 86 transmits a signal to and receives a signal from an external device such as a higher-ranking device disposed outside the banknote handling machine 10.

As shown in FIG. 14, the depositing and dispensing unit 20 includes a depositing and dispensing unit control unit 72 for controlling components of the depositing and dispensing unit 20. To the depositing and dispensing unit control unit 72, the banknote feeding mechanism 24, the banknote feeding mechanism 26, the shutter 28, the guide unit 30, the pressing member 34, the first partition member 36, the second partition member 38, the camera 60, and the light source 62 are connected. Data of an image taken by the camera 60 is transmitted to the depositing and dispensing unit control unit 72. The depositing and dispensing unit control unit 72 transmits a command signal to each of the banknote feeding mechanism 24, the banknote feeding mechanism 26, the shutter 28, the guide unit 30, the pressing member 34, the first partition member 36, the second partition member 38, the camera 60, and the light source 62, thereby controlling these components.

The depositing and dispensing unit control unit 72 determines, on the basis of the image data obtained by the camera 60, whether or not a plurality of banknotes placed in the placement unit 22 are bundled by a bundling member such as a rubber band or strapping paper. A method for the determination by the depositing and dispensing unit control unit 72 will be described below in detail. When the depositing and dispensing unit control unit 72 determines that a plurality of banknotes placed in the placement unit 22 are bundled by a bundling member, the depositing and dispensing unit control unit 72 outputs information on the bundling member. The information outputted by the depositing and dispensing unit control unit 72 is transmitted to the main body control unit 70, and the main body control unit 70 causes the operation display unit 80 to display the information on the bundling member, causes the memory unit 82 to store the information thereon, causes the printing unit 84 to print the information thereon on a receipt or the like, or causes the communication unit 86 to transmit the information thereon to an external device such as a higher-ranking device. The information on the bundling member represents information indicating whether or not a plurality of banknotes placed in the placement unit 22 are bundled by a bundling member such as a rubber band or strapping paper, and information on a kind of the bundling member (specifically, information indicating that a kind of a material of the bundling member is, for example, a rubber band or strapping paper) in the case of the banknotes being bundled by the bundling member.

The depositing and dispensing unit control unit 72 also outputs image data obtained by the camera 60. The image data outputted by the depositing and dispensing unit control unit 72 is transmitted to the main body control unit 70, and the main body control unit 70 causes the operation display unit 80 to display the image data, causes the memory unit 82 to store the image data, causes the printing unit 84 to print the image data on a receipt or the like, or causes the communication unit 86 to transmit the image data to an external device such as a higher-ranking device.

As shown in FIG. 14, to the depositing and dispensing unit control unit 72, a criterion setting unit 74 and a memory unit 76 are connected. The criterion setting unit 74 sets a criterion based on which the depositing and dispensing unit control unit 72 determines whether or not a plurality of banknotes placed in the placement unit 22 are bundled by a bundling member. A method in which the criterion setting unit 74 sets the criterion will be described below. In the memory unit 76, data of an image taken by the camera 60 is stored. When the depositing and dispensing unit control unit 72 determines that a plurality of banknotes placed in the placement unit 22 are bundled by a bundling member, the information on the bundling member may be stored in the memory unit 76.

In the banknote handling machine 10 of the present embodiment, the main body control unit 70 may have a function as the depositing and dispensing unit control unit 72 described above without providing the depositing and dispensing unit control unit 72 in the depositing and dispensing unit 20. In this case, image data obtained by the camera 60 is transmitted directly to the main body control unit 70, and the main body control unit 70 determines, on the basis of the image data obtained by the camera 60, whether or not a plurality of banknotes placed in the placement unit 22 are bundled by a bundling member such as a rubber band or strapping paper.

Next, an operation of the depositing and dispensing unit 20 in the banknote handling machine 10 of the present embodiment will be described.

Firstly, an operation performed by the depositing and dispensing unit 20 in banknote depositing will be described with reference to FIG. 2 to FIG. 5. In banknote depositing by the banknote handling machine 10, when an operator inputs a deposit instruction by using the operation display unit 80, the shutter 28 of the depositing and dispensing unit 20 opens, as shown in FIG. 2. When the operator puts a bundle of banknotes in the standing state into the placement unit 22, a banknote inlet opening is closed by the shutter 28 as indicated by an arrow in FIG. 3. Thereafter, as indicated by an arrow in FIG. 4, the pressing member 34 moves along the bottom surface 23 of the placement unit 22 toward the banknote feeding mechanism 24, whereby the bundle of banknotes put in the placement unit 22 is sandwiched between the pressing member 34 and the guide unit 30. As shown in FIG. 5, in a state where the bundle of banknotes is sandwiched therebetween, the guide unit 30 and the pressing member 34 integrally move toward the banknote feeding mechanism 24. While the pressing member 34 presses the bundle of banknotes in the placement unit 22 toward the kicker roller 24*a* of the banknote feeding mechanism 24, the kicker roller 24*a* rotates clockwise in FIG. 5, whereby a banknote located at the left-lowermost position in FIG. 5, among the banknotes placed in the placement unit 22, is kicked downward by the kicker roller 24*a*, and the banknotes having been kicked one by one are fed one by one into the upper housing 12 by the feed roller 24*b*.

In the banknote depositing, when a banknote recognized by the recognition unit 42 as being not a normal banknote is returned as a rejected note to the depositing and dispensing unit 20, the banknote transported from the transport unit 40 to the depositing and dispensing unit 20 passes through the gate unit formed between the feed roller 26*b* and the opposing roller 26*c* in the banknote feeding mechanism 26 and is transported to the placement unit 22. At this time, the banknotes that have passed through the gate unit formed between the feed roller 26*b* and the opposing roller 26*c* are transported to the outlet region formed between the first partition member 36 and the second partition member 38, and are stacked in the standing state in the outlet region. Thereafter, when all the banknotes located between the guide unit 30 and the pressing member 34 are fed into the upper housing 12, and the first partition member 36 and the second partition member 38 move to a banknote dispensing position as shown in FIG. 8, the shutter 28 opens to allow the operator to take out the rejected notes stacked between the first partition member 36 and the second partition member 38 in the placement unit 22, to the outside of the upper housing 12.

Figure 6:
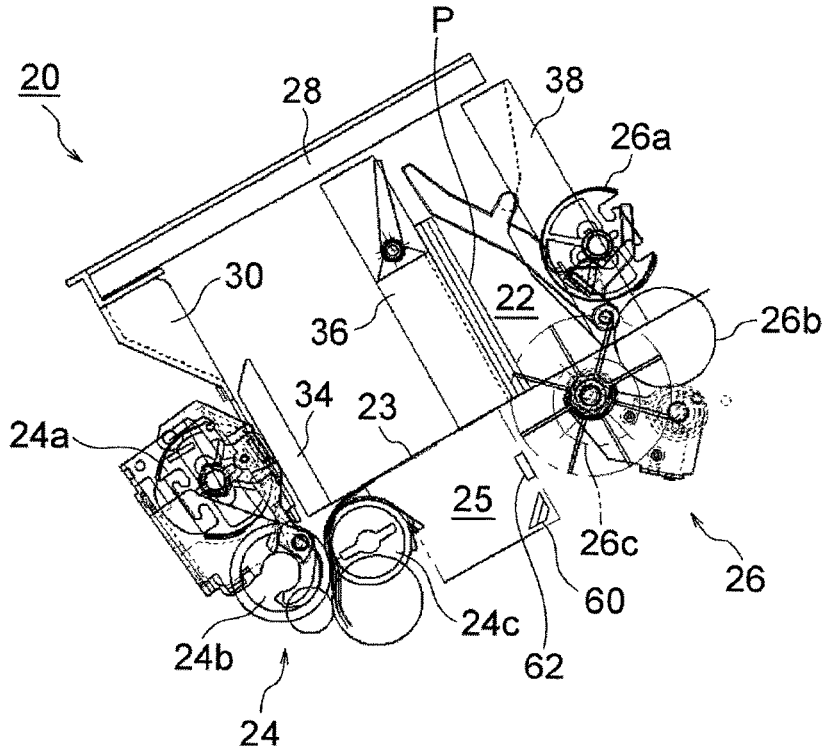
FIG. 6 illustrates the structure of the depositing and dispensing unit in the banknote handling machine shown in FIG. 1, and illustrates an operation performed in banknote dispensing.

Next, an operation performed by the depositing and dispensing unit 20 in banknote dispensing will be described with reference to FIG. 6 to FIG. 9. In banknote dispensing by the banknote handling machine 10, when an operator inputs a dispensing instruction by using the operation display unit 80, the guide unit 30 and the pressing member 34 move toward the banknote feeding mechanism 24 as shown in FIG. 6. Thereafter, the banknotes transported from the transport unit 40 to the depositing and dispensing unit 20 pass through the gate unit formed between the feed roller 26*b* and the opposing roller 26*c* in the banknote feeding mechanism 26, and are transported to the placement unit 22. At this time, the banknotes that have passed through the gate unit formed between the feed roller 26*b* and the opposing roller 26*c*, are transported to the outlet region formed between the first partition member 36 and the second partition member 38, and are stacked in the standing state in the outlet region.

Figure 7:
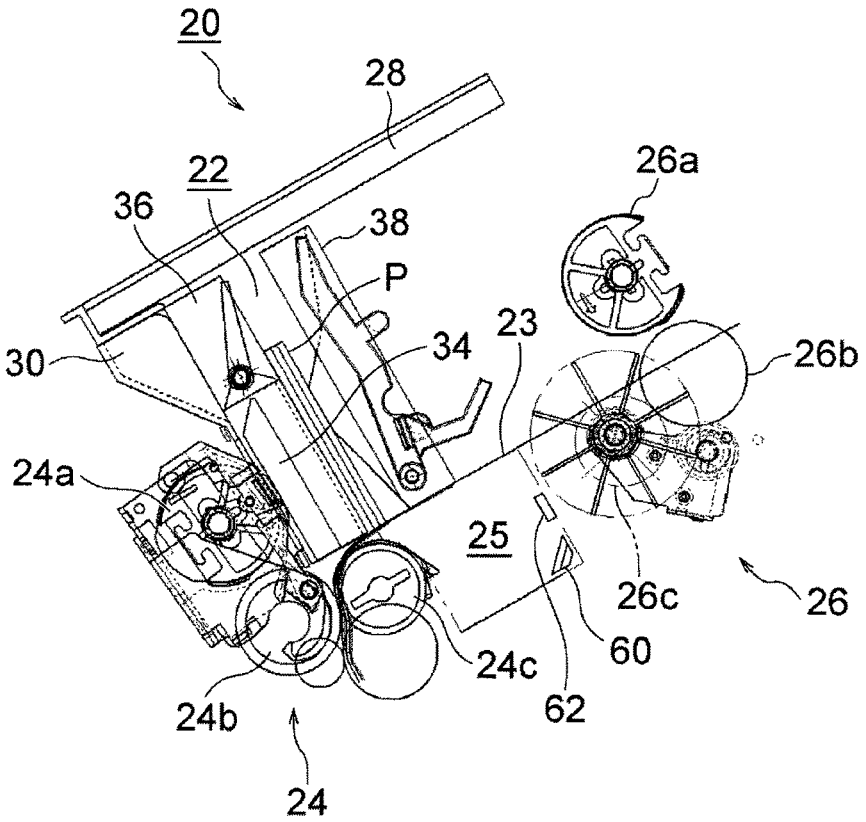
FIG. 7 illustrates the structure of the depositing and dispensing unit in the banknote handling machine shown in FIG. 1, and illustrates an operation, in the banknote dispensing, performed following the operation shown in FIG. 6.

Thereafter, when banknotes of a predetermined monetary amount are stacked in the standing state in the outlet region formed between the first partition member 36 and the second partition member 38, the first partition member 36 and the second partition member 38 move toward the banknote feeding mechanism 24 as shown in FIG. 7. When the first partition member 36 contacts with the surface of the guide unit 30, the first partition member 36 and the second partition member 38 stop at the positions shown in FIG. 7. Thereafter, as shown in FIG. 8, the second partition member 38 moves toward the banknote feeding mechanism 26. Thus, the outlet region formed between the first partition member 36 and the second partition member 38 is enlarged. When the second partition member 38 stops at the position shown in FIG. 8, the shutter 28 opens and the operator is allowed to take out the dispensed banknotes stacked between the first partition member 36 and the second partition member 38 in the placement unit 22, to the outside of the upper housing 12, as shown in FIG. 9.

As described above, in a case where the banknotes are not taken out from the depositing and dispensing unit 20 when a predetermined time has elapsed after opening of the shutter 28 of the depositing and dispensing unit 20, the banknotes are fed one by one from the depositing and dispensing unit 20 to the transport unit 40 by the banknote feeding mechanism 26, and the banknotes having been fed are transported to the banknote storage/feed cassette 50 or the banknote storage cassette 52 by the transport unit 40 and the transport unit 41. At this time, the first partition member 36 and the second partition member 38 each move along the bottom surface 23 of the placement unit 22 toward the banknote feeding mechanism 26 to reach the position shown in FIG. 6, and the banknotes in the outlet region between the first partition member 36 and the second partition member 38 are pressed in the upper-right direction in FIG. 6 by the first partition member 36 so as to contact with the kicker roller 26*a* of the banknote feeding mechanism 26. By the kicker roller 26*a* rotating counterclockwise in FIG. 6, a banknote located at the right-uppermost position in FIG. 6, among the banknotes placed in the placement unit 22, is kicked downward by the kicker roller 26*a*, and the banknotes having been kicked one by one are fed one by one into the upper housing 12 by the feed roller 26*b*. Thus, the banknotes placed in the placement unit 22 are fed into the upper housing 12, and the banknotes having been fed are stored in the banknote storage/feed cassette 50 or the banknote storage cassette 52 by the transport unit 40 and the transport unit 41.

Figure 4:
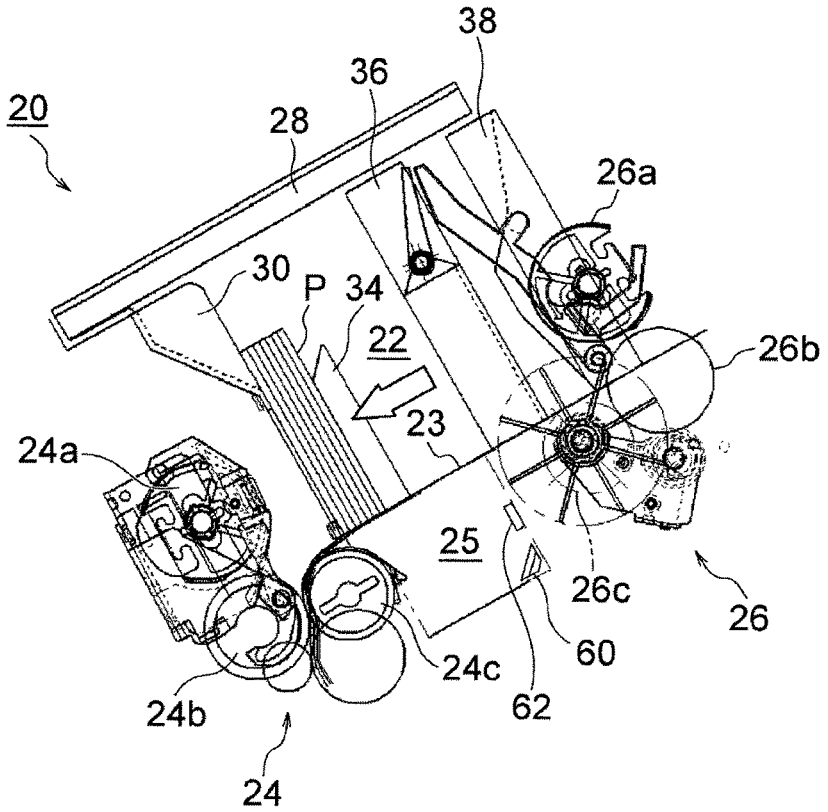
FIG. 4 illustrates the structure of the depositing and dispensing unit in the banknote handling machine shown in FIG. 1, and illustrates an operation, in the banknote depositing, performed following the operation shown in FIG. 3.
Figure 5:
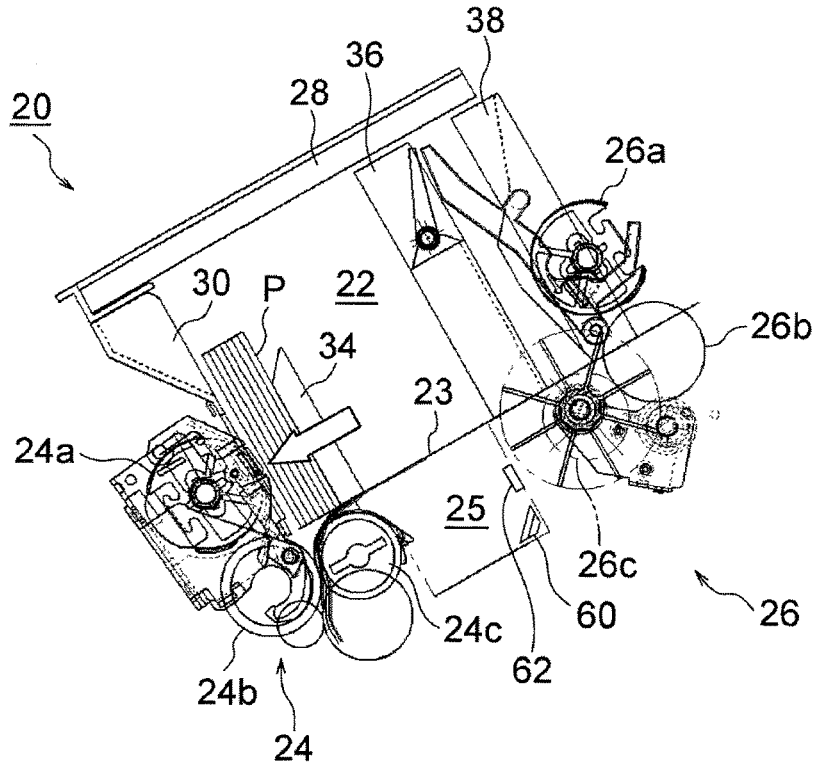
FIG. 5 illustrates the structure of the depositing and dispensing unit in the banknote handling machine shown in FIG. 1, and illustrates an operation, in the banknote depositing, performed following the operation shown in FIG. 4.

In the banknote handling machine 10 of the present embodiment, in banknote depositing, when a bundle of banknotes placed in the placement unit 22 is sandwiched between the pressing member 34 and the guide unit 30 as shown in FIG. 4, an image of the side edge portion (lower edge portion), on the placement member 23*a* side, of the bundle of banknotes placed in the placement unit 22 is taken by the camera 60, to thus obtain data of an image including the side edge portion of the bundle of banknotes. At this time, although the placement unit 22 is closed by the shutter 28, light is applied to the placement unit 22 by the light source 62, whereby the data of the image including the side edge portion of the bundle of banknotes can be obtained by the camera 60.

In the present embodiment, when the bundle of banknotes placed in the placement unit 22 is sandwiched between the pressing member 34 and the guide unit 30 as shown in FIG. 4, the image of the bundle of banknotes is taken by the camera 60. Instead thereof, in the present embodiment, as shown in FIG. 3, after the bundle of banknotes is put into the placement unit 22 by an operator, when the banknote inlet opening is closed by the shutter 28, the image of the bundle of banknotes may be taken by the camera 60. Whether the image of the bundle of banknotes is taken by the camera 60 in the state shown in FIG. 3 or in the state shown in FIG. 4 may be selectively determined. Specifically, an operator performs an input, on the operation display unit 80, as to whether the image of the bundle of banknotes is taken by the camera 60 in the state shown in FIG. 3 or in the state shown in FIG. 4, so that, when the pressing member 34 or the like is in a position as indicated by the input on the operation display unit 80, the depositing and dispensing unit control unit 72 may cause the camera 60 to take an image of the bundle of banknotes. Further, setting as to whether the image of the bundle of banknotes is taken by the camera 60 in the state shown in FIG. 3 or in the state shown in FIG. 4 may be performed from an external device through the communication unit 86. The image of the bundle of banknotes may be taken by the camera 60 in both the state shown in FIG. 3 and the state shown in FIG. 4. In this case, the depositing and dispensing unit control unit 72 uses data of a plurality of images taken by the camera 60 in the different states, and determines whether or not the plurality of banknotes placed in the placement unit 22 are bundled by a bundling member such as a rubber band or strapping paper.

FIG. 15 illustrates, in (a) to (c) thereof, various examples of image data obtained by the camera 60. Since a plurality of the placement members 23*a* that form the bottom surface 23 of the placement unit 22 are located between the camera 60 and the bundle of banknotes, each placement member 23*a* appears in the image data obtained by the camera 60 as indicated by reference character A in (a) to (c) of FIG. 15. Among the image data shown in FIG. 15, (a) represents image data obtained by the camera 60 when banknotes placed in the placement unit 22 are not bundled by a bundling member such as a rubber band or strapping paper, (b) represents image data obtained by the camera 60 when banknotes placed in the placement unit 22 are bundled by a rubber band (reference character B represents the rubber band that appears in the image data), and (c) represents image data obtained by the camera 60 when banknotes placed in the placement unit 22 are bundled by strapping paper (reference character C represents the strapping paper that appears in the image data).

As shown in (b) and (c) of FIG. 15, in the image data obtained by the camera 60, a bundling member such as a rubber band or strapping paper by which the banknotes are bundled is featured by appearing as s linear shape that is almost parallel to the thickness direction (up-down direction in FIG. 15) of the banknotes in the image. The depositing and dispensing unit control unit 72 utilizes the feature to analyze the taken image, whereby the bundling member such as a rubber band or strapping paper is detected. Due to the physical structure of the placement unit 22, each placement member 23*a* provided in the bottom surface 23 of the placement unit 22 always appears in the image data obtained by the camera 60 (see reference character A in (a) to (c) of FIG. 15). Therefore, a region in which each placement member 23*a* appears is set as a region in which detection for the bundling member is not performed. Thus, the placement member 23*a* appearing in the image is prevented from being erroneously detected as the bundling member.

In a case where a bundle of new banknotes is put into the placement unit 22, when an image of the side edge portion, on the placement member 23*a* side, of the bundle of the banknotes is taken by the camera 60, a line that is almost parallel to the thickness direction of the banknotes may appear in the image data due to a portion in which colors in design of the banknote at the side edge portion change although the banknotes are not bundled by a bundling member, and the bundling member may be erroneously detected. In order to prevent such a problem, the depositing and dispensing unit control unit 72 determines, in the following determination method, whether or not banknotes placed in the placement unit 22 are bundled by a bundling member.

In a case where banknotes are bundled by a rubber band, since the rubber band by which the banknotes are bundled is a three-dimensional object, the depositing and dispensing unit control unit 72 detects such a three-dimensional object. Specifically, as described above, the light source 62 includes the plurality of LEDs 62*a* to 62*k* aligned along the width direction (left-right direction in FIG. 13) of the banknotes placed in the standing state on the placement members 23*a* of the placement unit 22. Therefore, the LEDs 62*a* to 62*k* apply light to the placement unit 22 from different directions, thereby taking a plurality of images. Specifically, firstly, the camera 60 takes an image of the placement unit 22 in a state where all the LEDs 62*a* to 62*k* are lit up. Thus, an area, among the area 1 to the area 5 in FIG. 13, in which a linear shape that is almost parallel to the thickness direction of the banknotes appears in the image data, is detected. Next, in the area, among the area 1 to the area 5, in which the linear shape that is almost parallel to the thickness direction of the banknotes appears in the image data, only the LEDs positioned to the left, in the width direction of the placement unit 22 (a direction orthogonal to a direction in which each placement member 23*a* extends), of the linear shape that is almost parallel to the thickness direction of the banknotes in the image data, are lit up in the light source 62. In this state, an image is taken by the camera 60. Thereafter, in the area, only the LEDs positioned to the right, in the width direction of the placement unit 22, of the linear shape that is almost parallel to the thickness direction of the banknotes in the image data, are lit up in the light source 62. In this state, an image is taken by the camera 60. Thus, data of two images taken by the camera 60 by light being applied to the placement unit 22 from different directions, is obtained. In the data of these two images, shadows of the three-dimensional object such as a rubber band are formed. Since light is applied to the placement unit 22 from the different directions, the position at which the shadow is formed is different between data of the two images. The depositing and dispensing unit control unit 72 evaluates a difference (specifically, shadows of the three-dimensional object such as a rubber band) between the two images obtained by light being applied to the placement unit 22 from the different directions. The depositing and dispensing unit control unit 72 determines, when the difference between the two images is great, that a three-dimensional object such as a rubber band is present, and determines, when the difference therebetween is small, that no three-dimensional object is present.

Strapping paper by which banknotes are bundled has a plain surface or has a surface that is uniformly colored with a single color. When banknotes placed in the placement unit 22 are bundled by strapping paper, the image data obtained by the camera 60 is such that an image is uniform in one of regions obtained by division at a boundary that is the linear shape almost parallel to the thickness direction of the banknotes, and an image is not uniform in the other of the regions. Specifically, two regions obtained by division at the boundary that is the linear shape almost parallel to the thickness direction of the banknotes in the image data, have brightness values different from each other. The depositing and dispensing unit control unit 72 detects the difference in brightness value between these two regions, thereby determining that the banknotes placed in the placement unit 22 are bundled by strapping paper.

The criterion (specifically, for example, a threshold value for the difference between data of two images obtained by light being applied from different directions, a threshold value for difference in brightness value between two regions obtained by division at a boundary that is the linear shape almost parallel to the thickness direction of the banknotes in the image data) in the determination method described above, is set by the criterion setting unit 74. Specifically, an operator inputs, on, for example, a screen for maintenance, a criterion for the determination method described above by using the operation display unit 80, or information on the criterion is transmitted from a higher-ranking device through the communication unit 86 to the banknote handling machine 10, whereby the criterion is set by the criterion setting unit 74.

Figure 17:
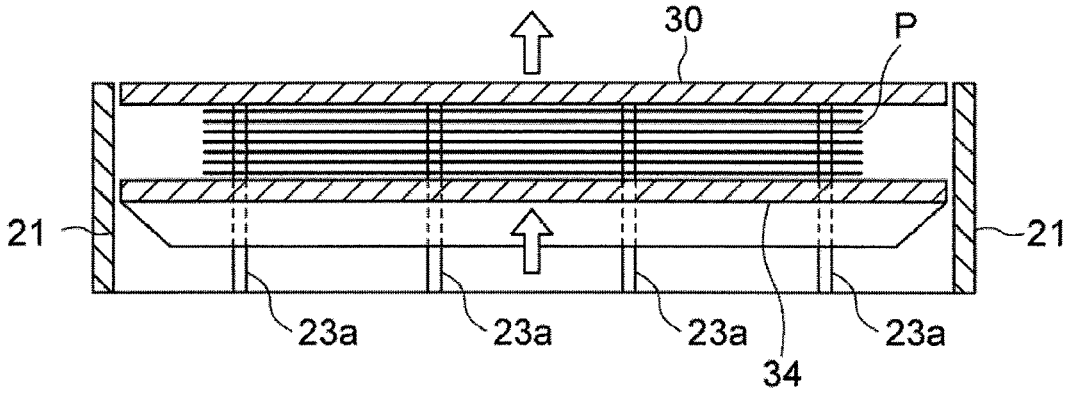
FIG. 17 illustrates a method for defining a range of image data obtained by the camera provided in the depositing and dispensing unit of the banknote handling machine shown in FIG. 1.

In the present embodiment, as shown in FIG. 17, marking with white or gray color is performed on a portion (portion indicated by diagonal lines in FIG. 17), in each of the side walls 21, the guide unit 30, and the pressing member 34 of the depositing and dispensing unit 20, of which the image is to be taken by the camera 60, that is, performed on the bottom surface of each of the side walls 21, the guide unit 30, and the pressing member 34 of the depositing and dispensing unit 20. When the image of the placement unit 22 is taken by the camera 60, such marking also appears in the obtained image data. In this case, when the depositing and dispensing unit control unit 72 determines whether or not banknotes placed in the placement unit 22 are bundled by a bundling member, determination is performed by using only the data of an image within the marked regions, among the image data obtained by the camera 60. That is, when banknote depositing is performed, the banknotes placed in the placement unit 22 are sandwiched between the guide unit 30 and the pressing member 34 as indicated by reference character P in FIG. 17, whereby the banknote placed in the placement unit 22 appear in the data of the image within the marked regions. Thus, when the banknotes are bundled by a bundling member, the bundling member also appears in the data of the image within the marked regions. Thus, a range, of the image data obtained by the camera 60, in which image processing is to be performed is defined by the marking, whereby the depositing and dispensing unit control unit 72 can more quickly determine whether or not banknotes are bundled by a bundling member, and, further, a rate of erroneous detection can be reduced in such a determination.

The depositing and dispensing unit control unit 72 detects a distance between a portion in which the marking on the bottom surface of the guide unit 30 appears in the image data obtained by the camera 60, and a portion in which the marking on bottom surface of the pressing member 34 appear in the image data obtained by the camera 60, thereby enabling calculation of, for example, the thickness of the bundle of banknotes put in the placement unit 22 in depositing, and the number of banknotes based on the thickness. Information, on the thickness or the number of deposited banknotes, outputted by the depositing and dispensing unit control unit 72 is transmitted to the main body control unit 70, and the main body control unit 70 causes the operation display unit 80 to display the information on the thickness or the number of deposited banknotes, causes the memory unit 82 to store the information thereon, causes the printing unit 84 to print the information thereon on a receipt or the like, or causes the communication unit 86 to transmit the information thereon to an external device such as a higher-ranking device. Thus, an operator can obtain the information (specifically, the thickness or the number of deposited banknotes) on the deposited banknotes, on the basis of the image data obtained by the camera 60.

In the present embodiment, instead of a method in which marking is performed on a portion, in each of the side walls 21, the guide unit 30, and the pressing member 34 of the depositing and dispensing unit 20, of which the image is to be taken by the camera 60, and the depositing and dispensing unit control unit 72 makes determination by using only data of an image within the marked regions, the following determination method may be used. Specifically, since banknotes placed in the placement unit 22 are indicated with a relatively bright color in the image data obtained by the camera 60, when the depositing and dispensing unit control unit 72 determines whether or not the banknotes placed in the placement unit 22 are bundled by a bundling member, determination may be performed by using only the image data of the portion indicated with the relatively bright color, among the image data obtained by the camera 60. In this case, since the banknotes placed in the placement unit 22 appear in the image data of the portion indicated with the relatively bright color, when the banknotes are bundled by a bundling member, the bundling member also appears in the image data of the above-described region. A range, of the image data obtained by the camera 60, in which image processing is to be performed is thus defined, whereby the depositing and dispensing unit control unit 72 can more quickly determine whether or not banknotes are bundled by a bundling member, and, further, a rate of erroneous detection can be reduced in such a determination.

As another manner, a manner may be used in which the depositing and dispensing unit 20 includes a position detector such as an encoder or an interrupter that detects a position of each of the guide unit 30 and the pressing member 34, and, when the depositing and dispensing unit control unit 72 determines whether or not banknotes placed in the placement unit 22 are bundled by a bundling member, determination may be performed by using only the image data of a region, between the guide unit 30 and the pressing member 34, based on the positions detected by the position detector, among the image data obtained by the camera 60. As described above, when banknote depositing is performed, the banknotes placed in the placement unit 22 are sandwiched between the guide unit 30 and the pressing member 34, whereby the banknotes placed in the placement unit 22 also appear in the image data of the region between the guide unit 30 and the pressing member 34. Therefore, when the banknotes are bundled by a bundling member, the bundling member also appears in the image data of the region between the guide unit 30 and the pressing member 34. A range, of the image data obtained by the camera 60, in which image processing is to be performed is thus defined, whereby the depositing and dispensing unit control unit 72 can more quickly determine whether or not banknotes are bundled by a bundling member, and, further, a rate of erroneous detection can be reduced in such a determination.

In the present embodiment, as described above, when the depositing and dispensing unit control unit 72 determines that banknotes placed in the placement unit 22 are bundled by a bundling member such as a rubber band or strapping paper, the depositing and dispensing unit control unit 72 outputs the information on the bundling member. Specifically, the depositing and dispensing unit control unit 72 transmits the information on the bundling member to the main body control unit 70, and the main body control unit 70 causes the operation display unit 80 to display a message for prompting an operator to temporarily take out the bundle of the banknotes placed in the placement unit 22, remove the bundling member used for the bundling, and then put the banknotes into the placement unit 22 again. Instead of or in addition to the main body control unit 70 causing the operation display unit 80 to display such a message, the information on the bundling member may be transmitted to an external device such as a higher-ranking device by the communication unit 86, and the external device may be caused to display the message. At this time, the depositing and dispensing unit control unit 72 controls the shutter 28 so as to retract the shutter 28 from a position at which the placement unit 22 is closed, and open the banknote inlet opening (see FIG. 2), whereby the inside of the placement unit 22 can be accessed from the outside. The main body control unit 70 may cause the memory unit 82 to store the information on the bundling member, or may cause the printing unit 84 to print the information thereon on a receipt or the like.

When the depositing and dispensing unit control unit 72 determines that banknotes placed in the placement unit 22 are bundled by a bundling member, the banknote feeding mechanism 24 is controlled such that the banknote feeding mechanism 24 does not feed the banknotes placed in the placement unit 22 until the bundle of the banknotes placed in the placement unit 22 is taken out from the placement unit 22, the bundling member used for the bundling is removed, and the banknotes are put into the placement unit 22 again. Thus, a banknote which faces the kicker roller 24*a* of the banknote feeding mechanism 24 can be prevented from being abraded due to the kicker roller 24*a* rotating regardless of the banknotes placed in the placement unit 22 being bundled by a bundling member. Meanwhile, when the depositing and dispensing unit control unit 72 determines that banknotes placed in the placement unit 22 are not bundled by a bundling member, the banknote feeding mechanism 24 is controlled so as to start feeding the banknotes by the banknote feeding mechanism 24 for continuing depositing of the banknotes placed in the placement unit 22.

As described above, the depositing and dispensing unit control unit 72 also outputs the image data, as shown in (a) to (c) of FIG. 15, obtained by the camera 60. The image data outputted by the depositing and dispensing unit control unit 72 is transmitted to the main body control unit 70, and the main body control unit 70 causes the operation display unit 80 to display the image data, causes the memory unit 82 to store the image data, causes the printing unit 84 to print the image data on a receipt or the like, or causes the communication unit 86 to transmit the image data to an external device such as a higher-ranking device. In this case, when the depositing and dispensing unit control unit 72 determines that banknotes placed in the placement unit 22 are bundled by a bundling member such as a rubber band or strapping paper, the depositing and dispensing unit control unit 72 may perform marking (see reference character D in FIG. 16) on a portion, of the image data outputted by the depositing and dispensing unit control unit 72, in which the bundling member is present, as shown in FIG. 16.

In the banknote handling machine 10 of the present embodiment, also in banknote dispensing, in a state where a bundle of banknotes transmitted from the transport unit 40 to the placement unit 22 is sandwiched between the first partition member 36 and the second partition member 38, the side edge portion, on the placement member 23*a* side, of the bundle of banknotes placed in the placement unit 22 may be taken by the camera 60, thereby obtaining image data in which the side edge portion of the bundle of banknotes appears. At this time, although the placement unit 22 is closed by the shutter 28, light is applied to the placement unit 22 by the light source 62, whereby the image data in which the side edge portion of the bundle of banknotes appears, can be obtained by the camera 60. The depositing and dispensing unit control unit 72 calculates, on the basis of the image data obtained by the camera 60, the thickness of the dispensed banknotes placed in the placement unit 22 or the number of the dispensed banknotes based on the thickness thereof, and outputs information on the thickness or the number of the dispensed banknotes which are obtained through the calculation. The information, on the thickness or the number of the dispensed banknotes, outputted by the depositing and dispensing unit control unit 72 is transmitted to the main body control unit 70, and the main body control unit 70 causes the operation display unit 80 to display the information on the thickness or the number of the dispensed banknotes, causes the memory unit 82 to store the information thereon, causes the printing unit 84 to print the information thereon on a receipt of the like, or causes the communication unit 86 to transmit the information thereon to an external device such as a higher-ranking device. Thus, an operator is allowed to obtain the information (specifically, the thickness or the number of dispensed banknotes) on the dispensed banknotes, on the basis of the image data obtained by the camera 60.

Figure 18:
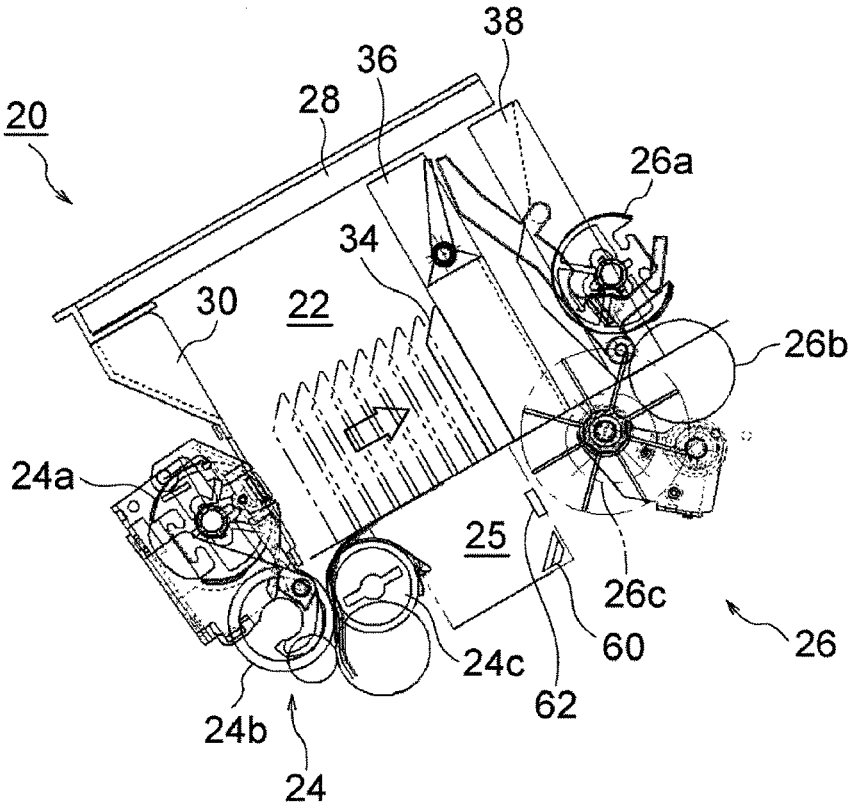
FIG. 18 illustrates an operation of moving a pressing member in a state where the camera provided in the depositing and dispensing unit of the banknote handling machine shown in FIG. 1, is exposed to light.

In the banknote handling machine 10 of the present embodiment, in banknote depositing, after all the banknotes placed in the placement unit 22 are fed into the upper housing 12 by the banknote feeding mechanism 24, the pressing member 34 moves away from a position (that is, banknote feeding position) near the banknote feeding mechanism 24 as shown in FIG. 18 (that is, moves in the upper-right direction as indicated by an arrow in FIG. 18), and returns into a predetermined original position near the first partition member 36. At this time, the camera 60 is maintained so as to be exposed to light, whereby one image may be obtained during the movement of the pressing member 34. As described above, marking with white or gray color is performed on the bottom surface of the pressing member 34. Therefore, when the pressing member 34 moves while the camera 60 is maintained so as to be exposed to light, the marking on the bottom surface of the pressing member 34 continuously appears in the image data obtained by the camera 60, and a range, in the image data, in which the bottom surface of the pressing member 34 moves is indicated with a bright color such as white. Therefore, when a foreign matter, dust, or the like is adhered to a lens of the camera 60, the foreign matter, dust, or the like appears clearly in the image data on the bright color such as white as described above, and an operator can recognize, when seeing the image data obtained by the camera 60, that the lens of the camera 60 is unclean. Also when a part of the placement members 23*a* provided in the bottom surface 23 of the placement unit 22 is damaged, the damaged part of the placement members 23*a* appears clearly in the image data on the bright color such as white described above, and an operator can recognize, when seeing the image data obtained by the camera 60, that the placement member 23*a* is damaged.

In the present embodiment, depending on to what country banknotes handled by the banknote handling machine 10 belong, a dimension between the side walls 21 in the depositing and dispensing unit 20 is changed according to the size of the banknote (specifically, dimension of the long edge of the banknote). Therefore, a guide member 90 corresponding to a country to which handled banknotes belong is attached between the paired left and right side walls 21 on both the sides, and an image of a mark on the bottom surface of the guide member 90 is taken by the camera 60, whereby whether or not a correct guide member 90 is attached is determined. More specifically, the bottom surface (specifically, surface, of the guide member 90, on a side opposing the camera 60) of the guide member 90 is marked with a plurality of white line-shaped marks. In this case, the number of the marks is different according to a kind of the guide member 90. Alternatively, a color of the marks may be different according to a kind of the guide member 90. An image is taken by the camera 60 in a state where no banknote is placed in the placement unit 22. In the image, the white line-shaped marks on the guide member 90 also appear. The depositing and dispensing unit control unit 72 or the main body control unit 70 detects an intensity of the white line-shaped mark that appears in the image data obtained by the camera 60, and detects the number of peaks at which the intensity of the mark exceeds a predetermined threshold value, whereby the kind of the guide member 90 is determined. Thus, whether or not a correct guide member 90 is attached is determined on the basis of the image data obtained by the camera 60. When the guide member 90 is not appropriate, an external device is notified of the error through the communication unit 86.

Figure 20:
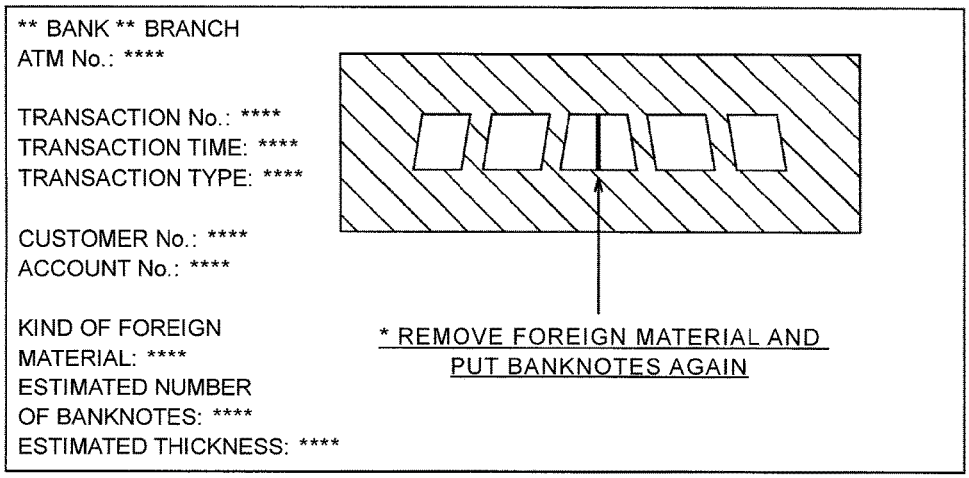
FIG. 20 illustrates a screen displayed on an operation display unit when a bundle of banknotes placed in the placement unit of the depositing and dispensing unit in the banknote handling machine shown in FIG. 1 is returned to an operator thereof.

In the banknote handling machine 10 of the present embodiment, when the depositing and dispensing unit control unit 72 determines that banknotes placed in the placement unit 22 are bundled by a bundling member, and the bundled banknotes are returned to an operator, a screen as shown in FIG. 20 is displayed by the operation display unit 80. Specifically, information (transaction number, transaction time, transaction type) on transaction, customer information (customer number, account number, and the like), and information on: a kind of a foreign material (bundling member); the number of bundled banknotes; the thickness thereof; and the like, are displayed on the operation display unit 80, and the image data obtained by the camera 60 is displayed on the operation display unit 80. On the display screen of the operation display unit 80, a position of the bundling member is indicated by an arrow or the corresponding portion is enclosed by a mark, and a message indicating "Remove foreign material and put banknotes again" is displayed. The information displayed with the image by the operation display unit 80 can be optionally set. In some cases, an operator who receives, by issuing an instruction for returning banknotes during depositing, the returned banknotes, makes a complaint that there is a difference from the number of the deposited banknotes. Also in such cases, an image obtained when banknotes are placed in the placement unit 22 of the depositing and dispensing unit 20, an image obtained when the banknotes are compressed between the guide unit 30 and the pressing member 34, and information indicating, for example, the estimated number of banknotes having been put into the depositing and dispensing unit 20 are indicated to the operator on the operation display unit 80, thereby avoiding such a trouble. Such a trouble avoiding method by display on the operation display unit 80 can be utilized also when banknotes left inadvertently in banknote dispensing are taken into the machine body of the banknote handling machine 10.

Figure 21:
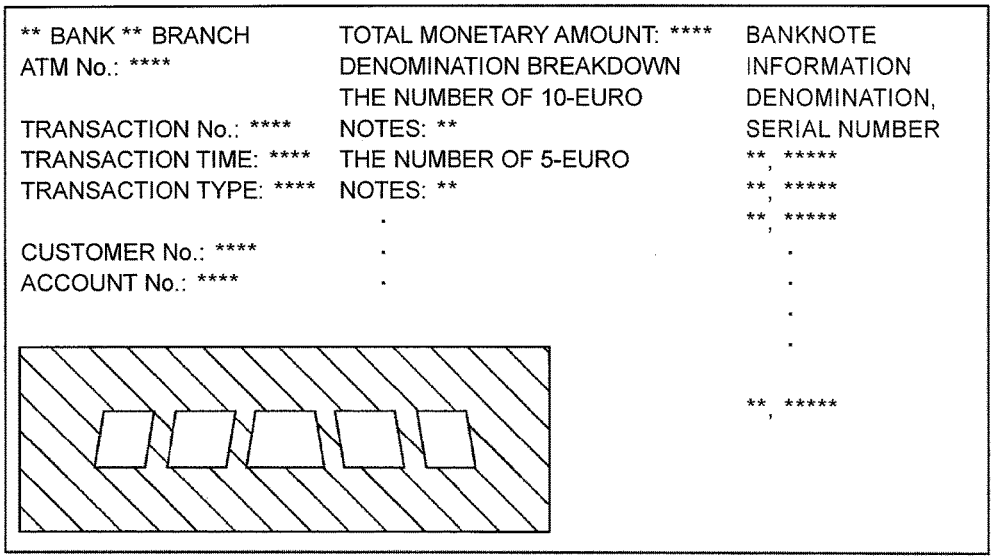
FIG. 21 illustrates image data and transaction information stored in a memory unit of the banknote handling machine shown in FIG. 1.

The main body control unit 70 causes the memory unit 82 to store image data obtained by the camera 60, and the transaction information so as to be associated with each other. The image data and the transaction information stored in the memory unit 82 will be described with reference to FIG. 21. As shown in FIG. 21, information (transaction number, transaction time, transaction type) on transaction, customer information (customer number, account number, and the like), the total monetary amount of banknotes, and the number of banknotes for each denomination (denomination breakdown) are stored in the memory unit 82, and image data obtained by the camera 60 is stored in the memory unit 82. The recognition unit 42 can obtain not only denominations of the banknotes but also serial numbers by OCR, and banknote denomination information and serial number information are stored as banknote information in the memory unit 82. The serial number information need not be the banknote serial number itself obtained through OCR by the recognition unit 42, and may be an image of a serial number portion in the banknote or a size-reduced banknote image. In, for example, the banknote depositing, the banknote dispensing, and taking-in of banknotes left inadvertently as described above, when an operator (customer) makes a complaint that, for example, the number of banknotes is incorrect, the above information and the like may be displayed on the operation display unit 80 so as to enable the operator to make confirmation.

In the banknote handling machine 10 of the present embodiment having the above-described structure, as described above, by the camera 60 that serves as an imaging unit, an image of the side edge portion, on the placement member 23*a* side, of banknotes placed in the placement unit 22 is taken to obtain image data. The depositing and dispensing unit control unit 72 determines, on the basis of the image data obtained by the camera 60, whether or not the banknotes placed in the placement unit 22 are bundled by a bundling member such as a rubber band or strapping paper. Thus, by the camera 60 that serves as the imaging unit, an image of the side edge portion, on the placement member 23*a* side, of the banknotes placed in the placement unit 22 is taken to obtain image data, so that, when a plurality of banknotes bundled by a bundling member such as strapping paper or a rubber band are placed in the placement unit 22, the bundling member appears clearly in the image taken by the camera 60 as shown in (b) and (c) of FIG. 15. Therefore, whether or not the plurality of banknotes placed in the placement unit 22 are bundled by a bundling member can be determined on the basis of the image data obtained by the camera 60.

In the banknote handling machine 10 of the present embodiment, as described above, when the depositing and dispensing unit control unit 72 determines that a plurality of banknotes placed in the placement unit 22 are bundled by a bundling member, the depositing and dispensing unit control unit 72 outputs the information on the bundling member. As described above, the information on the bundling member represents information indicating whether or not a plurality of banknotes placed in the placement unit 22 are bundled by a bundling member such as a rubber band or strapping paper, and/or information on a kind of the bundling member in the case of the banknotes being bundled by a bundling member (specifically, information indicating whether a kind of the bundling member is, for example, a rubber band or strapping paper).

In the banknote handling machine 10 of the present embodiment, as described above, the criterion setting unit 74 is connected to the depositing and dispensing unit control unit 72, and the criterion setting unit 74 sets a criterion based on which the depositing and dispensing unit control unit 72 determines whether or not a plurality of banknotes placed in the placement unit 22 are bundled by a bundling member.

In the banknote handling machine 10 of the present embodiment, as described above, the depositing and dispensing unit control unit 72 outputs image data obtained by the camera 60. At this time, as shown in FIG. 16, a portion, of the image data outputted by the depositing and dispensing unit control unit 72, in which the bundling member is present, may be marked.

In the banknote handling machine 10 of the present embodiment, as described above, the placement members 23*a* are formed as a plurality of bar-line members, and the spaces 23*b* are formed between the bar-like members. The foreign material receiver unit 25 for storing a foreign material which drops from the placement unit 22 through the spaces 23*b* is provided below the placement unit 22, and the camera 60 is disposed in the foreign material receiver unit 25.

In the banknote handling machine 10 of the present embodiment, as described above, when the depositing and dispensing unit control unit 72 determines that a plurality of banknotes placed in the placement unit 22 are bundled by a bundling member, the banknote feeding mechanism 24 is controlled so as not to feed therefrom the banknotes placed in the placement unit 22.

As described above, the banknote handling machine 10 of the present embodiment includes: the shutter 28 for opening and closing the banknote inlet opening through which banknote are put into the placement unit 22; and the light source 62 for applying light to the placement unit 22. The depositing and dispensing unit control unit 72 controls the camera 60 such that an image of the banknotes placed in the placement unit 22 is taken by the camera 60 in a state where the banknote inlet opening is closed by the shutter 28, and light is applied to the placement unit 22 by the light source 62. When the depositing and dispensing unit control unit 72 determines that a plurality of banknotes placed in the placement unit 22 are bundled by a bundling member, the shutter 28 is controlled so as to retract from the banknote inlet opening and open the banknote inlet opening. The light source 62 includes a plurality of LEDs 62*a* to 62*k* that are aligned along the width direction of the banknotes placed in the standing state in the placement unit 22, and light is applied to the placement unit 22 from the plurality of LEDs 62*a* to 62*k* from different directions, whereby a shadow of the bundling member (specifically, for example, a rubber band) can be formed in the image data obtained by the camera 60.

In the banknote handling machine 10 of the present embodiment, as described above, the depositing and dispensing unit control unit 72 outputs information on the thickness or the number of the banknotes placed in the placement unit 22. The thickness or the number thereof is calculated on the basis of the image data obtained by the camera 60. Thus, in banknote depositing or dispensing, an operator is allowed to obtain information (specifically, the thickness or the number of deposited banknotes or dispensed banknotes) on deposited banknotes or dispensed banknotes, on the basis of the image data obtained by the camera 60.

In the banknote handling machine 10 of the present embodiment, as described above, the image data obtained by the camera 60 is stored in, for example, the memory unit 76 provided in the depositing and dispensing unit 20 or the memory unit 82 connected to the main body control unit 70. The banknote handling machine 10 of the present embodiment is not limited to the above-described structure. Although the image data obtained by the camera 60 is used to determine whether or not banknotes are bundled by a bundling member, the image data may be discarded without storing the image data in the memory unit 76 or the memory unit 82.

In the banknote handling machine 10 of the present embodiment, as described above, the depositing and dispensing unit control unit 72 is not disposed in the depositing and dispensing unit 20, and the main body control unit 70 may have a function as the depositing and dispensing unit control unit 72 described above. In this case, the image data obtained by the camera 60 is transmitted directly to the main body control unit 70, and the main body control unit 70 determines, on the basis of the image data obtained by the camera 60, whether or not a plurality of banknotes placed in the placement unit 22 are bundled by a bundling member such as a rubber band or strapping paper.

The banknote handling machine 10 of the present embodiment is not limited to the above described structures, and various modification can be devised.

For example, in the above description for the banknote handling machine 10, the camera 60 is installed below the placement members 23*a* of the placement unit 22. However, a place in which the camera 60 is installed is not limited to such an example. The camera 60 may be installed at a position other than the position below the placement members 23*a* of the placement unit 22 when an image of the side edge portion, on the placement member 23*a* side, of the banknotes placed in the placement unit 22, or an image of the side edge portion, on the side opposite to the placement member 23*a* side, of the banknotes placed in the placement unit 22, can be taken to obtain image data. Specifically, the camera 60 may be installed at a position (that is, a position between the shutter 28 and the placement members 23*a*) near the lower surface of the shutter 28 that has closed the banknote inlet opening, and an image of the side edge portion, on the side opposite to the placement member 23*a* side, of the banknotes placed in the placement unit 22 may be taken by the camera 60 to obtain image data. Also in this case, the depositing and dispensing unit control unit 72 can determine, on the basis of the image data obtained by the camera 60, whether or not the banknotes placed in the placement unit 22 are bundled by a bundling member such as a rubber band or strapping paper.

In a case where the camera 60 that takes an image of the placement unit 22 is disposed inside the depositing and dispensing unit 20, whether or not a fake shutter in a trick in cash theft, is attached at the banknote inlet opening of the depositing and dispensing unit 20, can be determined in the following method.

Figure 19:
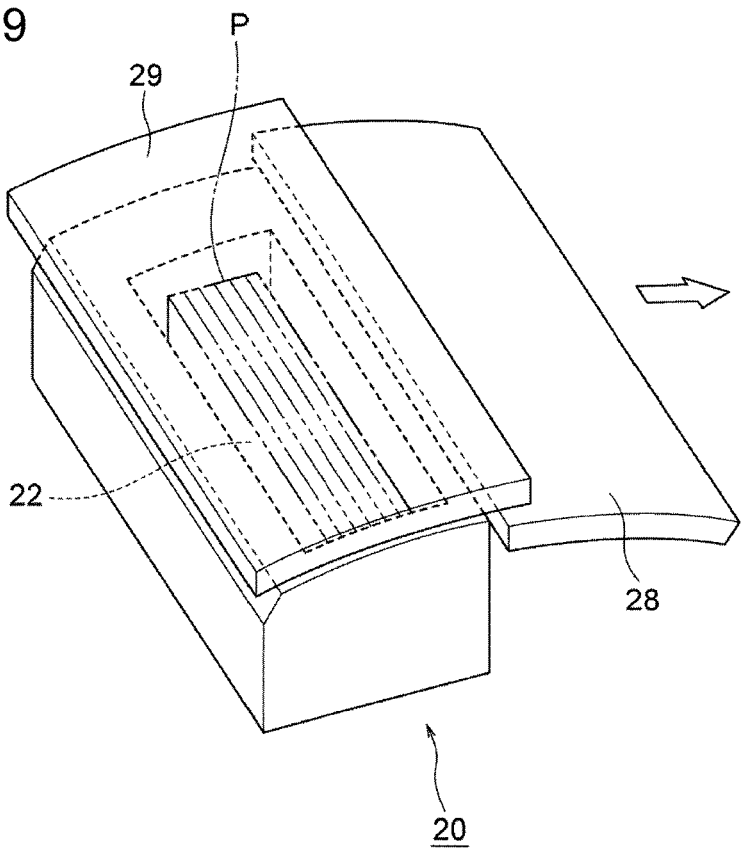
FIG. 19 illustrates a state where the placement unit of the depositing and dispensing unit in the banknote handling machine shown in FIG. 1 is covered by a fake shutter.

A trick in cash theft in which a fake shutter is attached at the banknote inlet opening of the depositing and dispensing unit 20 will be described below. In the banknote handling machine 10, a thief of cash theft firstly attaches a fake shutter 29 at the banknote inlet opening of the depositing and dispensing unit 20, as shown in FIG. 19. In this case, although, in a normal state, when the subsequent operator performs an operation for banknote dispensing in the banknote handling machine 10, the shutter 28 opens to allow the operator to access dispensed banknotes in the placement unit 22, the dispensed banknotes in the placement unit 22 cannot be accessed since the fake shutter 29 is attached at the banknote inlet opening. Therefore, the operator judges that the banknote handling machine 10 is out of order, and moves away from the banknote handling machine 10 toward bank staff for notification thereof. While the operator is away from the banknote handling machine 10, the thief of the cash theft removes the fake shutter 29, takes out the dispensed banknotes from the placement unit 22, and carry them away.

In order to cope with such a trick of cash theft, when the camera 60 that takes an image of the placement unit 22 is disposed inside the depositing and dispensing unit 20, after the dispensing has been performed and before the banknote inlet opening is opened by the shutter 28, an image of the inside of the depositing and dispensing unit 20 is taken by the camera 60 to obtain image data. Thereafter, after the banknote inlet opening has been opened by the shutter 28, an image of the inside of the depositing and dispensing unit 20 is taken again by the camera 60 to obtain image data. The depositing and dispensing unit control unit 72 compares the two images, that is, compares the image data obtained before opening of the shutter 28 and the image data obtained after opening of the shutter 28 with each other. When the difference between the data of the two images is greater than a predetermined threshold value, it is determined that the fake shutter 29 is not attached and the banknote handling machine 10 is in a normal state. In this case, after it is confirmed that dispensed banknotes have been taken out from the placement unit 22, a series of dispensing operation is completed. Meanwhile, in a case where, when the depositing and dispensing unit control unit 72 compares the two images, that is, compares the image data obtained before opening of the shutter 28 and the image data obtained after opening of the shutter 28 with each other, a difference between the data of the two images is less than the predetermined threshold value (specifically, when both the images of the image data are almost the same), the depositing and dispensing unit control unit 72 determines that it is dark inside the placement unit 22 as in a state before opening of the shutter 28 although the shutter 28 opens. In this case, the depositing and dispensing unit control unit 72 determines that the fake shutter 29 may be attached at the banknote inlet opening, and the operation display unit 80 is caused to display warning by the main body control unit 70. In this case, the depositing and dispensing unit control unit 72 closes again the banknote inlet opening of the depositing and dispensing unit 20 by the shutter 28. Thus, even when the fake shutter 29 is attached at the banknote inlet opening, the dispensed banknotes transported from the transport unit 40 to the placement unit 22 can be prevented from being carried away by the thief of the cash theft.

According to the present invention, the banknote insertion apparatus for inserting banknotes into the machine body of the banknote handling machine 10 is not limited to the depositing and dispensing unit 20 configured to insert banknotes into the inside of the upper housing 12 from the outside thereof and dispense banknotes from the inside of the upper housing 12 to the outside thereof. The banknote insertion apparatus according to the present invention may be used as a depositing unit that merely performs an operation for inserting banknotes into the upper housing 12 from the outside thereof.

The paper sheet handling machine of the present invention is not limited to the banknote handling machine for performing, for example, banknote depositing and dispensing. The paper sheet handling machine of the present invention may be used as a machine or the like for performing depositing and dispensing of paper sheets such as checks or gift coupons other than banknotes. In this case, the paper sheet insertion apparatus of the present invention may be used as an apparatus or the like for inserting paper sheets such as checks or gift coupons other than banknotes into the machine body of the paper sheet handling machine.

The invention claimed is:

1. A paper sheet insertion apparatus for inserting a paper sheet into a machine body of a paper sheet handling machine, the paper sheet insertion apparatus comprising:

an imaging unit that takes an image of an interior of the paper sheet handling machine to obtain image data; and a control unit that is provided inside the machine body of the paper sheet handling machine and outputs information on foreign material other than the paper sheet and information on a constituent member of the paper sheet insertion apparatus, based on the image data obtained by the imaging unit, wherein the constituent member includes a shutter for closing a paper sheet inlet through which the paper sheet is put into the paper sheet insertion apparatus, and the control unit compares the image data obtained by the imaging unit before and after the shutter opens the paper sheet inlet, and when a difference between the image data obtained by the imaging unit before and after the shutter opens the paper sheet inlet is smaller than a predetermined threshold value, the control unit determines that a fake shutter may be attached to the paper sheet inlet.

2. The paper sheet insertion apparatus according to claim 1, wherein the imaging unit obtains image data including a side edge portion of the paper sheet inside the paper sheet insertion apparatus.

3. The paper sheet insertion apparatus according to claim 1, wherein the foreign material other than the paper sheet is a bundling member for bundling paper sheets.

4. The paper sheet insertion apparatus according to claim 1, wherein the control unit closes the paper sheet inlet with the shutter when the control unit determines that the fake shutter may be attached to the paper sheet inlet.

5. A paper sheet insertion apparatus for inserting a paper sheet into a machine body of a paper sheet handling machine, the paper sheet insertion apparatus comprising:

an imaging unit that takes an image of an interior of the paper sheet handling machine to obtain image data; and a control unit that is provided inside the machine body of the paper sheet handling machine and outputs information on foreign material other than the paper sheet and information on a constituent member of the paper sheet insertion apparatus, based on the image data obtained by the imaging unit, wherein the constituent member includes a guide member attached to the paper sheet insertion apparatus, and the control unit determines whether the guide member is appropriate corresponding to the size of the paper sheet to be processed based on the image data of the guide member.

6. The paper sheet insertion apparatus according to claim 5, wherein the guide member is provided with a mark for identifying the guide member, the imaging unit takes an image including the mark provided on the guide member to obtain image data, and the control unit determines whether the guide member is appropriate corresponding to the size of the paper sheet to be processed, based on the mark of the image data.

7. A paper sheet insertion apparatus for inserting a paper sheet into a machine body of a paper sheet handling machine, the paper sheet insertion apparatus comprising:

an imaging unit that is provided inside the machine body of the paper sheet handling machine and takes an image of a side edge portion of the paper sheet inside the paper sheet insertion apparatus to obtain image data; and a control unit that outputs information on foreign material other than the paper sheet based on the image data obtained by the imaging unit, and a placement unit having an opening and in which a plurality of paper sheets are placed in a standing state on a placement member, wherein the imaging unit is provided below the placement member and takes an image of a substantially full length of the side edge portion in the longitudinal direction facing the placement member, of the plurality of paper sheets placed in the placement unit, through the opening, to obtain the image data, wherein the imaging unit takes an image of a constituent member of the paper sheet insertion apparatus to obtain image data, and the control unit outputs information on the constituent member based on the image data.

8. The paper sheet insertion apparatus according to claim 7, wherein the foreign material other than the plurality of paper sheets is a bundling member for bundling paper sheets.

9. The paper sheet insertion apparatus according to claim 7, wherein the constituent member includes a shutter for closing a paper sheet inlet through which the paper sheet is put into the paper sheet insertion apparatus.

10. The paper sheet insertion apparatus according to claim 9, wherein the control unit compares the image data obtained by the imaging unit before and after the shutter opens the paper sheet inlet, and when a difference between the image data obtained by the imaging unit before and after the shutter opens the paper sheet inlet is smaller than a predetermined threshold value, the control unit determines that a fake shutter may be attached to the paper sheet inlet.

11. The paper sheet insertion apparatus according to claim 7, wherein the constituent member includes a guide member attached to the paper sheet insertion apparatus.

12. The paper sheet insertion apparatus according to claim 11, wherein the control unit determines whether the guide member is appropriate corresponding to the size of the paper sheet to be processed based on the image data of the guide member obtained by the imaging unit.

* * * * *